US008720426B2

(12) United States Patent
Hadley et al.

(10) Patent No.: US 8,720,426 B2
(45) Date of Patent: May 13, 2014

(54) SOFT IMPACT PROJECTILE LAUNCHER

(75) Inventors: Robert Hadley, Yorba Linda, CA (US); Carlton Calvin, San Marino, CA (US)

(73) Assignee: Razor USA, LLC, Cerritos, CA (US)

( * ) Notice: Subject to any disclaimer, the term of this patent is extended or adjusted under 35 U.S.C. 154(b) by 447 days.

(21) Appl. No.: 13/035,266

(22) Filed: Feb. 25, 2011

(65) Prior Publication Data

US 2012/0216786 A1 Aug. 30, 2012

(51) Int. Cl.
*F41B 11/14* (2006.01)
*F41B 11/641* (2013.01)

(52) U.S. Cl.
CPC ..... *F41B 11/641* (2013.01)
USPC ..... 124/66

(58) Field of Classification Search
USPC ..... 124/63–67, 56; 42/54; 40/54
See application file for complete search history.

(56) References Cited

U.S. PATENT DOCUMENTS

| | | | | |
|---|---|---|---|---|
| 1,248,507 | A | 12/1917 | Lefever | |
| 2,031,785 | A | 2/1935 | North et al. | |
| 2,725,869 | A | 12/1955 | Barber | |
| 4,834,059 | A * | 5/1989 | Moorhouse et al. | 124/67 |
| 4,864,759 | A * | 9/1989 | Ferri | 42/54 |
| 5,105,571 | A * | 4/1992 | Kinchin et al. | 42/96 |
| 2,425,866 | A | 6/1994 | Conklin | |
| 5,535,729 | A | 7/1996 | Griffin et al. | |
| D386,543 | S | 11/1997 | Chikui et al. | |
| 5,988,152 | A | 11/1999 | Halter et al. | |
| 6,076,511 | A | 6/2000 | Grimm et al. | |
| D436,356 | S | 1/2001 | Lee | |
| 6,901,922 | B2 * | 6/2005 | Forti et al. | 124/62 |
| D516,660 | S | 3/2006 | Murello et al. | |
| 7,194,960 | B2 | 3/2007 | Vasel et al. | |
| 7,287,526 | B1 | 10/2007 | Bligh et al. | |
| 7,377,274 | B2 * | 5/2008 | Morikawa et al. | 124/71 |
| 7,481,209 | B1 * | 1/2009 | Bligh et al. | 124/63 |
| D606,614 | S | 12/2009 | Fitzpatrick et al. | |
| 7,640,927 | B1 | 1/2010 | Broersma | |
| 7,686,003 | B2 * | 3/2010 | Witzigreuter | 124/65 |
| D638,887 | S | 5/2011 | En | |
| 8,087,405 | B2 * | 1/2012 | Mitchell | 124/67 |
| D660,920 | S | 5/2012 | Johnson et al. | |
| D660,923 | S | 5/2012 | Johnson | |
| D660,924 | S | 5/2012 | Jablonski et al. | |
| D660,926 | S | 5/2012 | Mastin | |
| D664,606 | S | 7/2012 | Johnson | |
| D665,037 | S | 8/2012 | Mead | |
| D673,625 | S | 1/2013 | Mowbray | |
| 8,371,282 | B2 | 2/2013 | David | |

(Continued)

FOREIGN PATENT DOCUMENTS

| | | |
|---|---|---|
| FR | 2 186 639 | 1/1974 |
| GB | 456 096 A | 11/1936 |

(Continued)

*Primary Examiner* — Reginald Tillman, Jr.
(74) *Attorney, Agent, or Firm* — Knobbe, Martens, Olson & Bear, LLP

(57) ABSTRACT

A soft impact projectile launcher including a launching mechanism that creates a burst of air or air pressure in order to launch a projectile. The launching mechanism includes an outer cylinder and a spring-loaded piston configured to generate the burst of air. The projectile launcher may also include a projectile reservoir and a loading member that positions projectiles for launching. The projectile launcher can launch projectiles that are made from a superabsorbent polymer and consist of mostly water.

20 Claims, 17 Drawing Sheets

(56) References Cited

U.S. PATENT DOCUMENTS

| | | | | |
|---|---|---|---|---|
| 2004/0104533 | A1 | 6/2004 | Larson | |
| 2005/0066849 | A1 | 3/2005 | Kapeles et al. | |
| 2006/0005732 | A1 | 1/2006 | Forster | |
| 2006/0191523 | A1 | 8/2006 | Paletz | |
| 2007/0034197 | A1 | 2/2007 | Tschech | |
| 2008/0022990 | A1 * | 1/2008 | Mitchell | 124/65 |
| 2008/0053330 | A1 | 3/2008 | Haesclich | |
| 2011/0271940 | A1 | 11/2011 | Meggs | |
| 2011/0271941 | A1 | 11/2011 | David | |
| 2012/0152221 | A1 | 6/2012 | Niconovich | |

FOREIGN PATENT DOCUMENTS

| | | |
|---|---|---|
| GB | 2 213 916 | 4/1990 |
| WO | WO 98/31981 | 7/1998 |
| WO | WO 02/054008 | 7/2002 |
| WO | WO 2011/143138 | 5/2011 |
| WO | WO 2012/088188 A1 | 12/2011 |

* cited by examiner

SOFT IMPACT PROJECTILE LAUNCHER

BACKGROUND OF THE DISCLOSURE

1. Field of the Invention

Embodiments of the invention relate generally to launchers and, more specifically, to launchers that launch soft impact projectiles.

2. Description of the Related Art

Launchers that launch projectiles have become popular among children and adults. There are many different projectile launcher variations and designs. Launchers that are capable of launching a plurality of projectiles without reloading have been found to be very popular. Some launchers eject projectiles with a burst of pressurized air or gas. For example, some paintball guns use pressurized CO2 canisters or cartridges to generate a burst of gas. Other launchers use a spring-loaded piston within a cylinder to generate a burst of air.

The projectiles typically used with paintball guns have a somewhat hard outer shell and marking paint within the shell. Being hit by such projectiles can be painful and, thus, such projectiles are not very suitable for use with soft impact projectile launchers. Furthermore, the marking paint within the projectile leaves a lasting residue upon impact. Other projectiles commonly used with projectile launchers are often made from foam or rubber. These materials do not easily decompose and are not friendly to the environment if used outdoors. Such projectiles are often shaped like bullets and are not spherical. Non-spherical shapes can make it difficult and tedious to load the projectiles into the launcher. Many launchers require the user to load the projectiles one at a time or after each launching. Therefore, the current projectiles and corresponding launchers are undesirable and unsuitable for many applications and a need exists for improved launchers and projectiles.

SUMMARY OF THE DISCLOSURE

Preferred embodiments of the projectile launcher include a launching mechanism that generates a burst of air or air pressure within the launcher and without the use of outside air pressure sources. Preferred embodiments of the projectiles are configured to have a soft impact and do not have a hard outer surface or shell. The projectiles may also be configured to degrade quickly and leave little or no residue. Certain embodiments of the projectiles may also be spherical in shape and easily loadable into the projectile launcher.

A preferred embodiment involves a projectile launcher having an outer housing comprising a grip portion. A slide is movable relative to the outer housing between a cocked position and a released position. A barrel has a loading end and a muzzle end. A reservoir houses a plurality of projectiles and has an opening that permits communication with the barrel to permit a projectile to move from the reservoir to the barrel. A launching mechanism has a first portion and a second portion in sealed, sliding engagement with one another, which cooperate to define an air chamber. The first portion can be moved to a cocked position by the slide. A launch spring biases the first portion of the launching mechanism away from the cocked position. The movement of the first portion from the cocked position under the biasing force of the launch spring reduces a volume of the air chamber to create a burst of air capable of launching a projectile from the barrel. The second portion includes a loading member that selectively blocks the opening of the reservoir. The second portion moves with movement of the slide toward the cocked position such that the loading member unblocks the opening of the reservoir to permit a projectile to move from the reservoir through the opening to the barrel.

A preferred embodiment involves a launcher as described in the previous paragraph and further including a trigger mechanism configured to release the first portion of the launching mechanism from the cocked position and a barrel closure mechanism having at least one shutter member that normally blocks a muzzle end of the barrel. The at least one shutter member is moved to an open position to unblock the barrel when the trigger is actuated.

A preferred embodiment involves a launcher as described in the previous paragraphs, and in which the at least one shutter member includes a pair of shutter members that move away from one another to the open position to unblock the barrel.

A preferred embodiment involves a launcher as described in the previous paragraph, and in which the barrel closure mechanism includes a pair of angled arms, each of which engages a respective one of the pair of shutter members. The angled arms are movable with the trigger mechanism to move the pair of shutter members to the open position.

A preferred embodiment involves a projectile launcher including an outer housing comprising a grip portion, configured to be grasped by a user, and a barrel. A projectile is configured to move through the barrel and is constructed from a superabsorbent polymer. A reservoir portion is configured to store the projectile and is capable of communicating with the barrel to permit the projectile to move from the reservoir portion to the barrel. A launching mechanism includes an outer cylinder that is capable of fluid communication with the barrel and a piston movable within the outer cylinder and configured to generate air pressure within the outer cylinder for launching the projectile from the barrel.

A preferred embodiment involves a launcher as described in the previous paragraph and further including a barrel closure mechanism configured to prevent objects from entering the barrel through a muzzle end of the barrel. The barrel closure mechanism includes at least one shutter member that selectively blocks the barrel.

A preferred embodiment involves a launcher as described in the previous paragraph and further including a trigger that is operable to release the piston from a cocked position. Actuation of the trigger causes the barrel closure mechanism to unblock the portion of the barrel.

A preferred embodiment involves a launcher as described above and further comprising a positioning mechanism having a blocking portion that is normally biased to a position in which the blocking portion is located within the barrel to inhibit the projectile from moving past the blocking portion.

A preferred embodiment involves a launcher as described in the previous paragraph and in which the outer cylinder is operably coupled to a loading member that moves into and out of a portion of the barrel in order to permit a projectile to move from the reservoir portion to the barrel. The loading member pushes the projectile past the blocking portion of the positioning mechanism.

A preferred embodiment involves a launcher as described in the previous paragraph and in which the loading member moves out of a portion of the barrel when the piston is moved to a cocked position, allowing the projectile to enter the barrel.

A preferred embodiment involves a launcher as described above and in which the projectile is spherical in shape. A preferred embodiment involves a launcher as described above and in which the projectile is homogeneous.

A preferred embodiment involves a method of launching a projectile including displacing a portion of a cocking mechanism and removing a loading member from within an entry portion of a barrel to allow a projectile to enter the barrel. The projectile comprises a superabsorbent polymer material. The method further includes moving a spring-loaded piston within a cylinder of the projectile launcher toward a cocked position and moving the loading member into the entry portion of the barrel after the projectile has entered the barrel. The piston is released from the cocked position to generate air pressure within the cylinder and the barrel of the projectile launcher, the air pressure causing the projectile to launch out of the barrel portion of the projectile launcher.

A preferred embodiment involves the method described above and further including opening a barrel closing mechanism in response to actuation of a trigger that releases the piston to unblock a portion of the barrel.

A preferred embodiment involves the method described above wherein the removing of the loading member and the moving of the spring-loaded piston occur at the same time.

A preferred embodiment involves the method described above wherein the moving of the spring-loaded piston begins prior to the removing of the loading member.

A preferred embodiment involves a method of manufacturing a projectile including producing an unloaded pellet, the pellet comprising a superabsorbent polymer. The unloaded pellet is loaded with a liquid which increases the size of the pellet and produces a loaded projectile. The loaded projectile consists of equal to or greater than approximately 50% of the liquid. The loaded projectile is packaged in a container configured to hold multiple projectiles and further configured to protect the projectile from outside forces.

A preferred embodiment involves the method described above wherein the loaded projectile consists of equal to or greater than approximately 95% water.

A preferred embodiment involves the method described above wherein the unloaded pellet and the loaded projectile are spherical in shape and have diameters of approximately 2 millimeters and 12 millimeters, respectively.

A preferred embodiment involves the method described above wherein the container is made of a rigid plastic material.

BRIEF DESCRIPTION OF THE DRAWINGS

These and other features, aspects and advantages of the present invention are described below with reference to drawings of a preferred embodiment, which is intended to illustrate, but not to limit, the present invention. The drawings contain 13 figures.

DETAILED DESCRIPTION OF THE PREFERRED EMBODIMENTS

Preferred embodiments of the soft impact projectile launchers disclosed herein are configured to launch projectiles constructed from an acrylic polymer or superabsorbent polymer (SAP) material. Preferably, the projectiles are one size when initially created and increase to a significantly larger size when loaded with water or another suitable fluid (e.g., after being soaked in water or another suitable fluid for a period of time). Preferably, the projectiles are loaded prior to being launched from the soft impact projectile launcher. More preferably, the projectiles are loaded prior to being placed in a projectile reservoir of the projectile launcher. In some embodiments, the projectiles are loaded during the manufacturing process prior to packaging. Such projectiles are well-suited for use in soft impact projectile launchers. Preferred projectiles are relatively soft and, typically, at least substantially disintegrate upon impact. Some preferred embodiments of the projectiles are spherical in shape, which facilitates loading from the reservoir into the launching mechanism of the projectile launcher. Preferred embodiments of the projectiles can be launched by a variety of types of launchers, including the launchers described herein.

Figure 1:
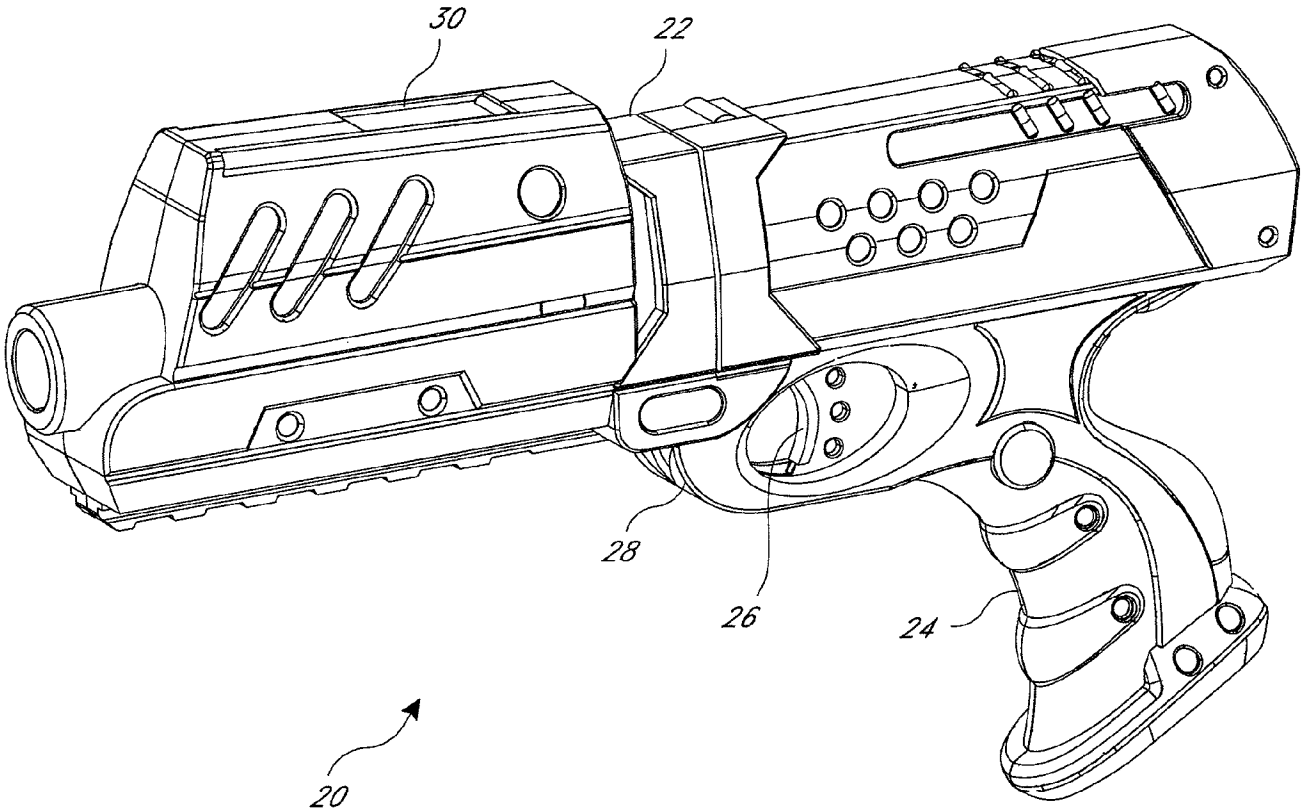
FIG. 1 is a perspective view of one embodiment of a projectile launcher.

FIG. 1 illustrates one embodiment of a soft impact projectile launcher 20 in accordance with the present invention. The projectile launcher 20 includes an outer housing 22 and a grip portion 24. Preferably, the grip portion 24 is sized and shaped so that it may be grasped by a user. The projectile launcher 20 also includes a trigger 26 adjacent to the grip portion 24. Preferably, the trigger 26 is accessible to the user's finger when the user is grasping the grip portion 24. The trigger 26 is configured to actuate a launching mechanism (described below) when squeezed or pulled by the user. As illustrated, a trigger guard 28 may also be included to support the trigger 26 or provide protection from inadvertent actuation of the trigger 26. Preferably, the projectile launcher 20 also includes a projectile reservoir 30 configured to receive and store projectiles for launching.

Figure 2:
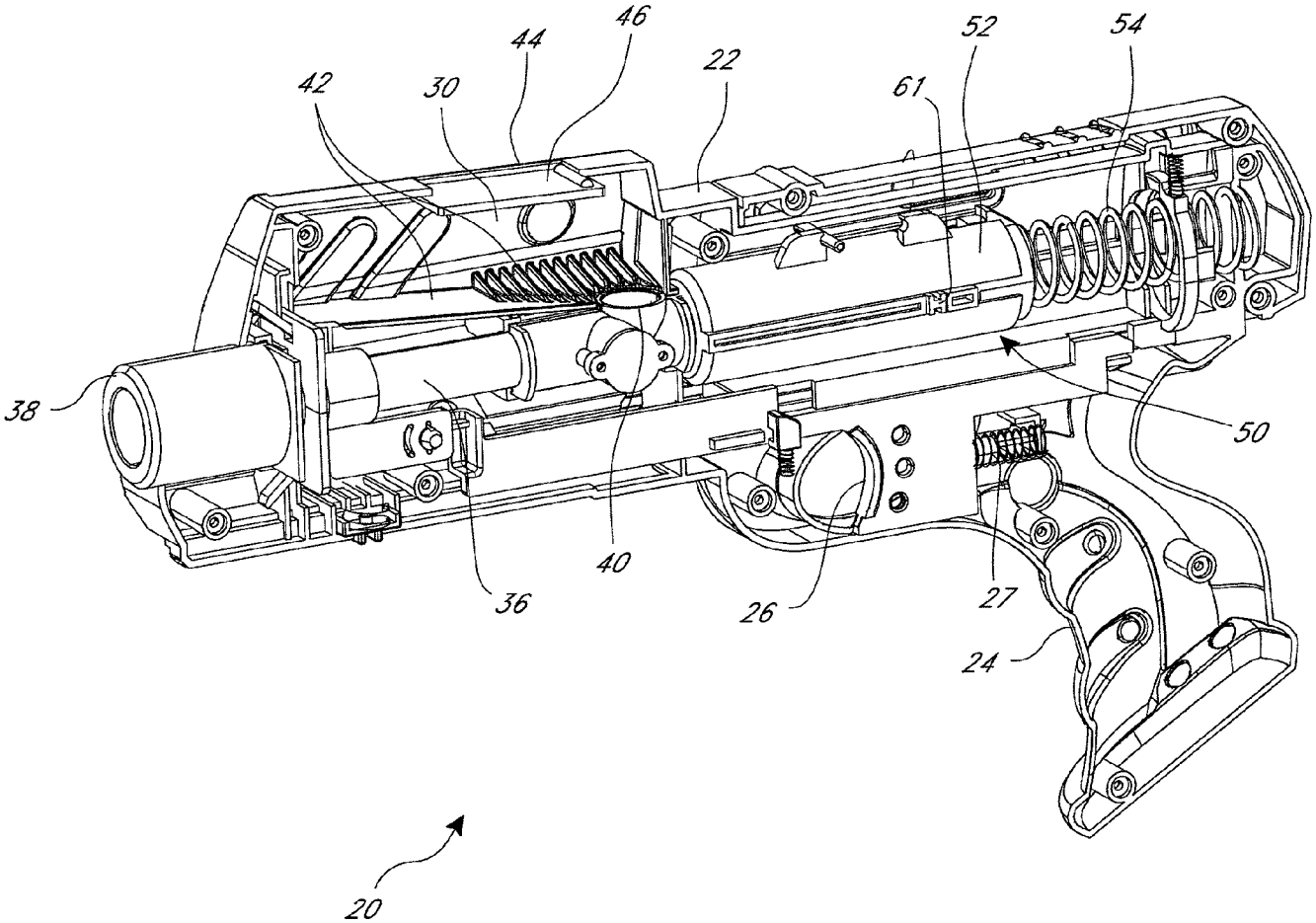
FIG. 2 is a perspective view of the projectile launcher of FIG. 1 with portions of the launcher removed.
Figure 3:
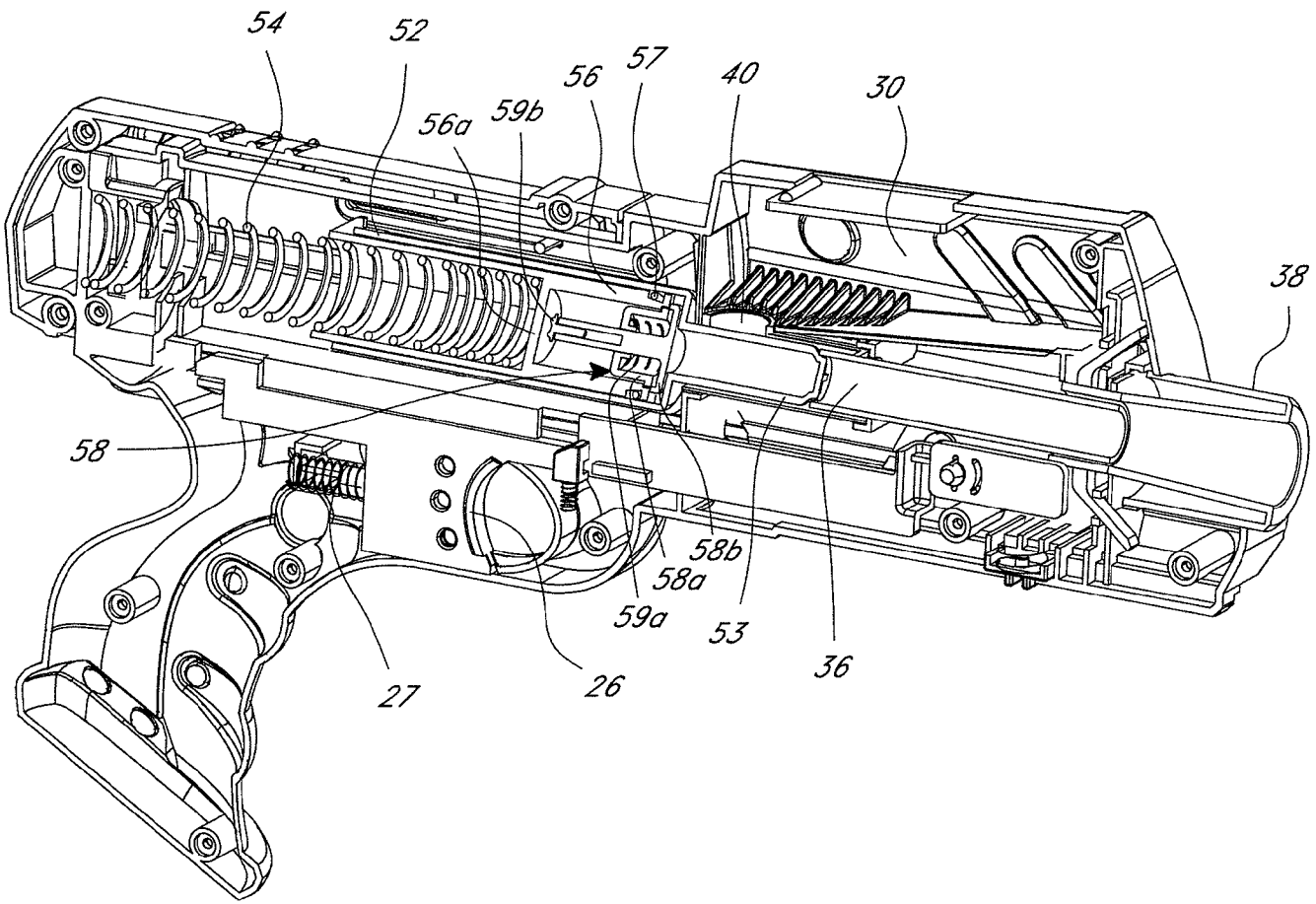
FIG. 3 is a perspective view of a cross-section of the projectile launcher of FIG. 1.
Figure 4:
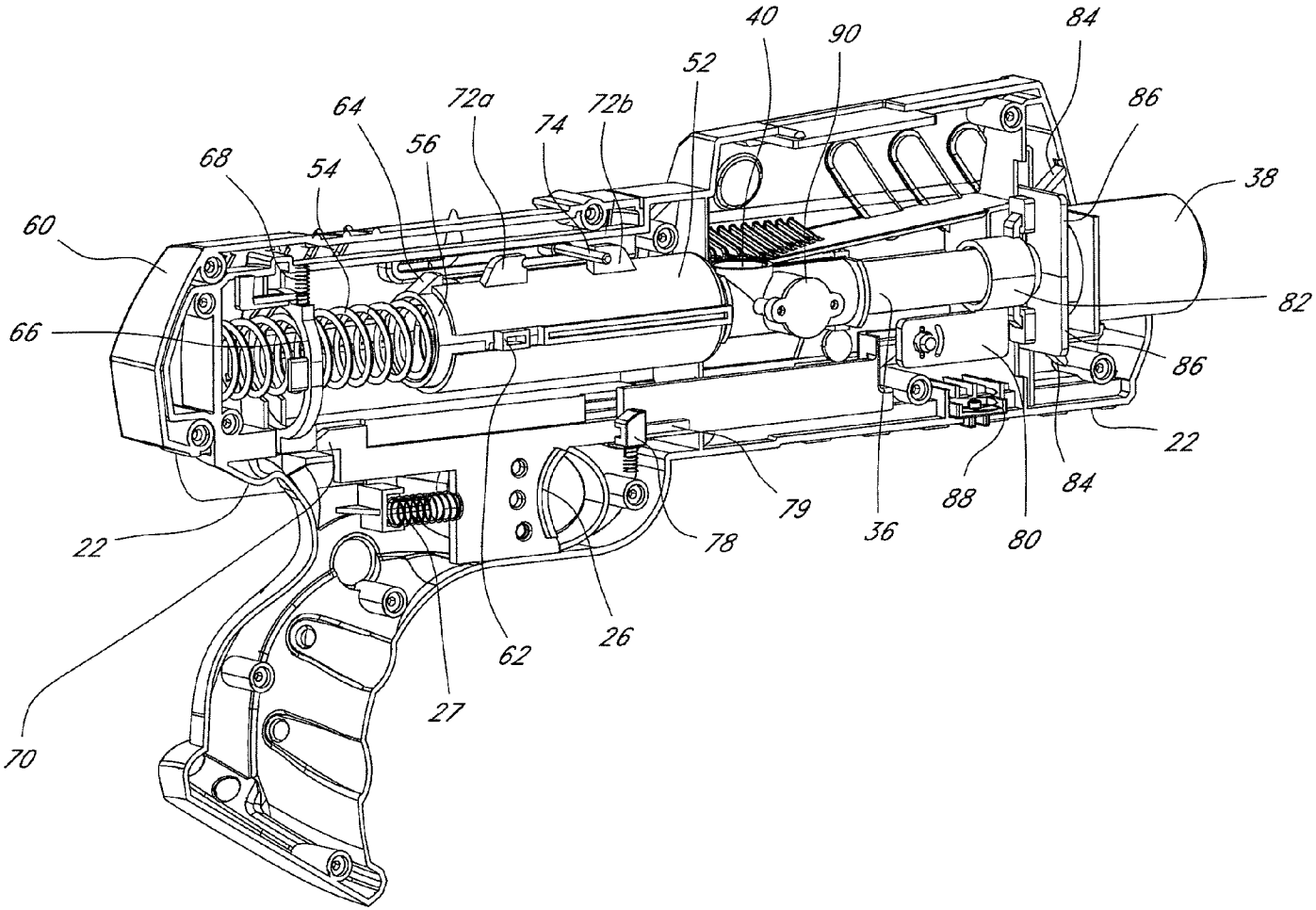
FIG. 4 is a perspective view of the projectile launcher of FIG. 1 with portions of the launcher removed.

FIGS. 2, 3 and 4 illustrate the interior of the projectile launcher 20 with portions of the outer housing 22 removed. The projectile launcher 20 includes a barrel 36 with a muzzle 38 proximate the end of the barrel 36. Preferably, the barrel 36 includes an entry portion 40 configured to allow a projectile to enter the barrel 36. The entry portion 40 may include an opening in the top of the barrel 36, or alternatively the opening can be on the sides or bottom of the barrel 36. In some embodiments, the barrel 36 includes a portion or chamber in which a projectile is held before it is launched. Preferably, the entry portion 40 of the barrel 36 receives projectiles from the projectile reservoir 30.

As illustrated, the projectile reservoir 30 may include sloped bottom portions 42 arranged to direct or funnel the projectiles toward the opening of the entry portion 40. The reservoir 30 includes an opening 44 configured for refilling the reservoir 30 with projectiles or emptying the projectiles from the reservoir 30. Preferably, the reservoir 30 includes a cap or lid 46 that may prevent projectiles from leaving the reservoir 30 through the opening 44. The lid 46 can slide relative to the housing 22 (such as within grooves) with some amount of resistance to inhibit unintentional opening or closing of the lid 46. Optionally, the lid 46 can be latched into the closed position. In other arrangements, the lid 46 may be spring loaded and biased towards a closed position. Preferably, the projectile reservoir 30 is generally hollow and can store multiple projectiles therein. As illustrated, the reservoir 30 is preferably configured above the barrel 36 so that the projectiles can fall into the entry portion 40 of the barrel 36. In other embodiments, the projectiles can be stored in one or more slots, or the projectiles may be stored in a single-file track that leads to an entry portion 40 of the barrel 36. Alternatively, the launcher 20 may include a rotating member, such as a cylinder, configured to store projectiles and place the projectiles in a launching position as the rotating member rotates. In other preferred embodiments, the projectile storage member or reservoir is removable from the launcher 20 and can be refilled by removing the reservoir and then recoupling it to the launcher 20. The storage member may take the form of a clip, magazine or hopper, for example. In such embodiments, the reservoir can come pre-filled with projectiles so that the reservoir can be easily replaced with a full reservoir when the projectiles have been launched.

The projectile launcher 20 includes a launching mechanism 50 which is configured to generate a burst of air that pushes a projectile through the barrel 36 and out of the muzzle 38. The launching mechanism 50 includes an outer cylinder 52 and a launch spring 54. Preferably, a loading member 53 is supported by the outer cylinder 52 and extends from the outer cylinder 52 in an axial direction. At least a portion of the loading member 53 is configured to move within a portion of the barrel 36. Preferably, the loading member 53 is configured to push or move a projectile from within the entry portion 40, through the rearward opening of the barrel 36, to a launching position. The loading member 53 is preferably cylindrical and of a smaller diameter than the rear portion of the outer cylinder 52. Preferably, a burst of air moves out of the outer cylinder 52 and through the loading member 53 to launch a projectile out of the barrel 36. Thus, the loading member 53 includes openings (such as openings at its forward end) that permit air to move through the loading member 53 and, preferably, also includes structure that is capable of pushing a projectile within the barrel 36. As illustrated, when the loading member 53 is within the entry portion 40 of the barrel 36, it blocks the opening into the barrel 36 and stops projectiles from entering the entry portion 40 of the barrel 36. When the outer cylinder 52 is moved backward away from the barrel 36 and the loading member 53 is removed from the entry portion 40 of the barrel 36, the entry portion 40 is open and can receive a projectile into the barrel 36.

As illustrated, the launching mechanism 50 also includes a piston 56 supported by the outer cylinder 52 and configured for sealed, sliding engagement within the outer cylinder 52. The piston 56 is biased toward the barrel 36 by the launch spring 54. The piston 56 may also include a ring or gasket 57 configured to create at least a substantial seal between the piston 56 and the outer cylinder 52. The illustrated piston 56 is an elongate cylinder or is generally sleeve-like in shape and defines an internal space. An internal wall portion **56*a* bisects the internal space of the piston 56 to define forward and rearward cavities within the internal space. The rearward cavity houses a portion of the launch spring 54. The forward cavity houses a shut-off valve arrangement 58. The shut-off valve arrangement 58 controls the flow of air between the cylinder 52 and the barrel 36. The illustrated shut-off valve arrangement 58 includes a carrier portion 58*a* supported by the piston 56 and a valve element 58*b* supported by the carrier portion 58*a* for sliding movement relative to the carrier portion 58*a*, along the longitudinal axis of the piston 56, between a first or extended position and a second or compressed position. A biasing element, such as a spring 59*a*, biases the valve element 58*b* toward the extended position. A stop element, such as the head portion of a screw 59*b*, contacts the carrier portion 58*a* to define the extended position. A forward end of the valve element 58*b* is configured to close off the cylinder 52 when it contacts the end of the cylinder 52 adjacent the loading member 53. The valve element 58*b* maintains a closed position against the cylinder 52 as the piston 56 is retracted relative to the cylinder 52 during the initial phase of the cocking sequence and maintains a closed position while both the piston 56 and the cylinder 52 are retracted together in the second phase of the cocking sequence, as described in greater detail below. The valve element 58*b* opens the cylinder 52 when the cylinder 52 moves forward and the piston 56 remains retracted. Upon actuation of the launching mechanism 50, the valve element 58*b* closes the cylinder 52 shortly before the piston 56 reaches the end of the cylinder 52. Preferably, the piston 56 moves in a direction that is parallel to or coaxial with the longitudinal axis of the barrel 36. However, in other embodiments the piston 56 may generate air pressure by moving in directions that are not parallel to or coaxial with the longitudinal axis of the barrel 36. Similarly, the longitudinal axis of the piston 56 and cylinder 52 is aligned with the longitudinal axis of the barrel 36**, but in other embodiments these axes are not aligned.

Preferably, the piston 56 can be moved to a cocked position within the outer cylinder 52 and away from the barrel 36. When released, the piston 56 moves toward the barrel 36 and forces air out of the outer cylinder 52 and loading member 53 and into the barrel 36. Thus, a burst of air is created by the moving piston 36 within the outer cylinder 52 and air pressure is generated to launch a projectile through the barrel 36 and out of the muzzle 38.

Preferably, the piston 56 can be reset to a cocked or ready position by a manual cocking mechanism. As illustrated in FIG. 4, the outer housing 22 includes a sliding portion, or slide, 60 that is configured to move with respect to the rest of the outer housing 22. Preferably, the sliding portion 60 is configured to be accessible to the user and is movable backward away from the barrel 36 to a cocking position. The piston 56 includes at least one tab 62 that protrudes radially from the piston 56. Preferably, the piston 56 includes two tabs 62, one corresponding to each side of the launcher 20. The tabs 62 are configured to be engaged by corresponding protruding portions 61 of the sliding portion 60. The protruding portions 61 preferably are tabs or other suitable structures that are fixed to or integral with the sliding portion 60. However, other suitable arrangements can also be used. Preferably, the protruding portions 61 of the sliding portion 60 engage the tabs 62 on the edge of the tab 62 closest to the barrel 36. Thus, when the sliding portion 60 is moved backward toward a cocking position and away from the barrel 36, the protruding portions 61 engage the tabs 62 and move the piston 56 away from the barrel 36 and toward a cocked position. The sliding portion 60 is then able to move forward, leaving the piston 56 in the cocked position. Preferably, the sliding portion 60 is biased toward the forward position by a biasing element, such as a spring 63 (see FIGS. 5A-5D). However, in other arrangements, the sliding portion 60 can be configured to be moved forward by the user.

The piston 56 also includes a latch portion 64. Preferably, the latch portion 64 is located at the top of the piston 56 adjacent to the end of the piston 56 furthest from the barrel 36. In other embodiments, the latch portion 64 can be located at other positions such as the bottom or sides of the piston 56. The launching mechanism 50 also includes a holding member, or sear, 66 that is supported by a portion of the outer housing 22 that does not move with the sliding portion 60. The holding member 66 is configured to receive and hold the latch portion 64 of the piston 56 when the piston 56 is moved into the cocked position. Preferably, the holding member 66 is supported by the outer housing 22 in a way that allows the holding member 66 to move so that it can receive and release the latch portion 64 of the piston 56. In the illustrated arrangement, the holding member 66 moves in a vertical direction, substantially perpendicular to the longitudinal axis of the barrel 36. A holding spring 68 may be supported by the outer housing 22 and configured to bias the holding member 66 toward a holding position (e.g., downward) in which it retains the latch portion 64 and piston 56 in a cocked position. The trigger 26 includes a release portion 70 supported by the trigger 26 and configured to engage a portion of the holding member 66 and displace the holding member 66 toward a position (e.g., upward) in which the holding member 66 releases the latch portion 64 of the piston 56.

The outer cylinder 52 preferably includes tabs 72*a* and 72*b* that protrude radially from the outer cylinder 52. As illustrated, the sliding portion 60 supports a rod or shaft 74 configured to engage the tabs 72*a* and 72*b*. In some embodiments, the tabs 72*a* and 72*b* may be hook-like in shape to partially surround the shaft 74. The shaft 74 engages the tabs 72*a* and 72*b* when the sliding portion 60 is moved toward and away from the barrel 36. When the sliding portion 60 is moved backward away from the barrel 36, the shaft 74 engages the rear tab 72*a* and moves the cylinder backward away from the barrel 36. Similarly, when the sliding portion 60 is moved forward toward the barrel 36, the shaft 74 engages the front tab 72*b* and moves the cylinder forward toward the barrel 36. As illustrated, the front tab 72*b* and the rear tab 72*a* are spaced from one another to create a lost-motion mechanism, the operation of which is described below.

The launcher 20 also includes a stop mechanism configured to inhibit backward movement of the trigger 26 when the sliding portion 60 is displaced backward and away from its forward resting position. The stop mechanism includes a stop member 78 that is supported by the outer housing 22 and is preferably biased upward toward a stopping position. When the sliding portion 60 is moved forward to a launching position, a portion of the sliding portion 60 engages and displaces the stop member 78 downward to an aligned position. The trigger 26 includes a pin portion 79. Preferably the pin portion 79 is sized and shaped to move within a slot on the stop member 78 when the stop member 78 is in the aligned position. When the sliding portion 60 is moved backward and away from the launching position, it disengages the stop member 78 which moves to its stopping position. With the stop member 78 in the stopping position, the slot on the stop member 78 and the pin portion 79 are not aligned so that the pin portion 79 is inhibited from moving backward past the stop member 78 and the trigger 26 is inhibited from being pulled backward. When the sliding portion 60 returns to its forward launching position, a portion of the sliding portion 60 engages the stop member 78 and displaces it downward to the aligned position. With the stop member 78 in the aligned position, the pin portion 79 can move backward through the slot on the stop member 78 so that the trigger 26 is not inhibited from being pulled backward. Therefore, the stop mechanism and stop member 78 can inhibit a user from pulling or depressing the trigger 26 while the sliding member 60 is in a cocking position or positioned backward away from the barrel 36. This can prevent undesired movement of sliding portion 60 when a projectile is launched and can help ensure that the sliding member 60 and cylinder 56 are returned to the launching position before a projectile is launched.

The trigger 26 is operatively coupled to a barrel closing mechanism 80 which is preferably supported by the outer housing 22 and/or barrel 36. The barrel closing mechanism 80 includes a cylindrical portion 82 and angled arms 84 extending from the cylindrical portion 82. The cylindrical portion 82 and angled arms 84 are movable with the trigger 26 and form an actuator of the barrel closing mechanism 80. The barrel closing mechanism 80 also includes shutter members 86 supported by the angled arms 84 and movable with respect to the barrel 36. Preferably, the shutter members 86 are located adjacent the front end of the barrel 36 and can move relative to one another between open and closed positions in a vertical direction perpendicular to the longitudinal axis of the barrel 36. As illustrated, the shutter members 84 are configured to block or cover the end of the barrel 36 when in a closed position. Preferably, when the shutter members 86 are in the closed position, they prevent objects from entering the barrel 36 through the muzzle 38.

The barrel closing mechanism 80 is configured so that when a user pulls the trigger 26, the trigger 26 moves in a rearward direction away from the barrel 36 causing the cylindrical portion 82 to move rearward, as well. As the cylindrical portion 82 moves in a rearward direction along the barrel 36, it pulls the angled arms 84 in the same direction away from the muzzle 38. Preferably, one of the angled arms 84 extends through a portion of one of the shutter members 86, and the other angled arm 84 extends through a portion of the other shutter member 86, as illustrated. Preferably, the shutter members 86 are supported by the outer housing 22 so that they can only move in the plane perpendicular to the longitudinal axis of the barrel 36, such as within vertical slots defined by walls of the housing 22, for example. Therefore, when the cylindrical portion 82 and angled arms 84 move backward with the trigger 26, the angled arms 84 cause the shutter members 86 to open by moving outward from the longitudinal axis of the barrel 36. Pulling the trigger 26 backward to the launching position thus causes the shutter members 86 to open and unblock the end of the barrel 36, allowing a projectile to be launched out of the unblocked barrel 36.

The projectile launcher preferably includes an attachment mechanism or portion 88. Preferably, the attachment portion 88 is supported by the outer housing 88 below the barrel 36. In other embodiments, the attachment portion 88 is located above or to the side of the barrel 36. The attachment portion 88 may be configured to couple attachments or other devices to the launcher 20 or the outer housing 22. For example, attachments might include secondary weapons, picatinny lights or lasers, bayonets, or other devices. The attachment portion 88 may include a spring and a retaining clip arranged to better secure attachments to the launcher 20. The attachment portion 88 may also include a picatinny rail to be used to connect certain attachments.

Figure 6:
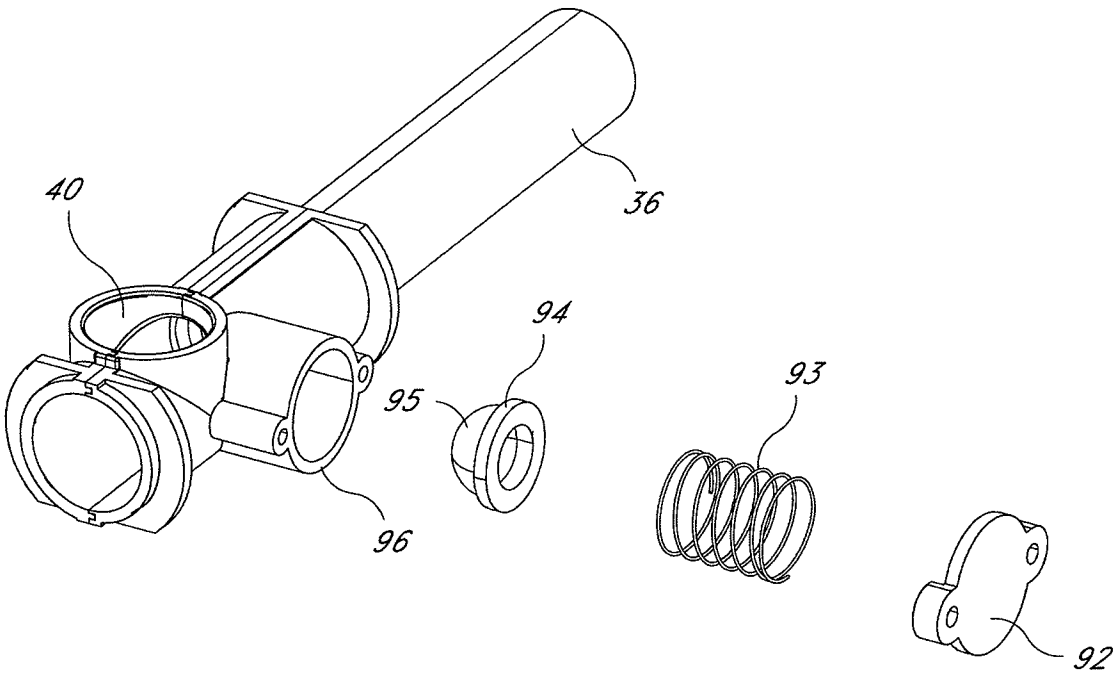
FIG. 6 is a perspective view of the positioning mechanism of the projectile launcher of FIG. 1, with its parts removed.
Figure 7:
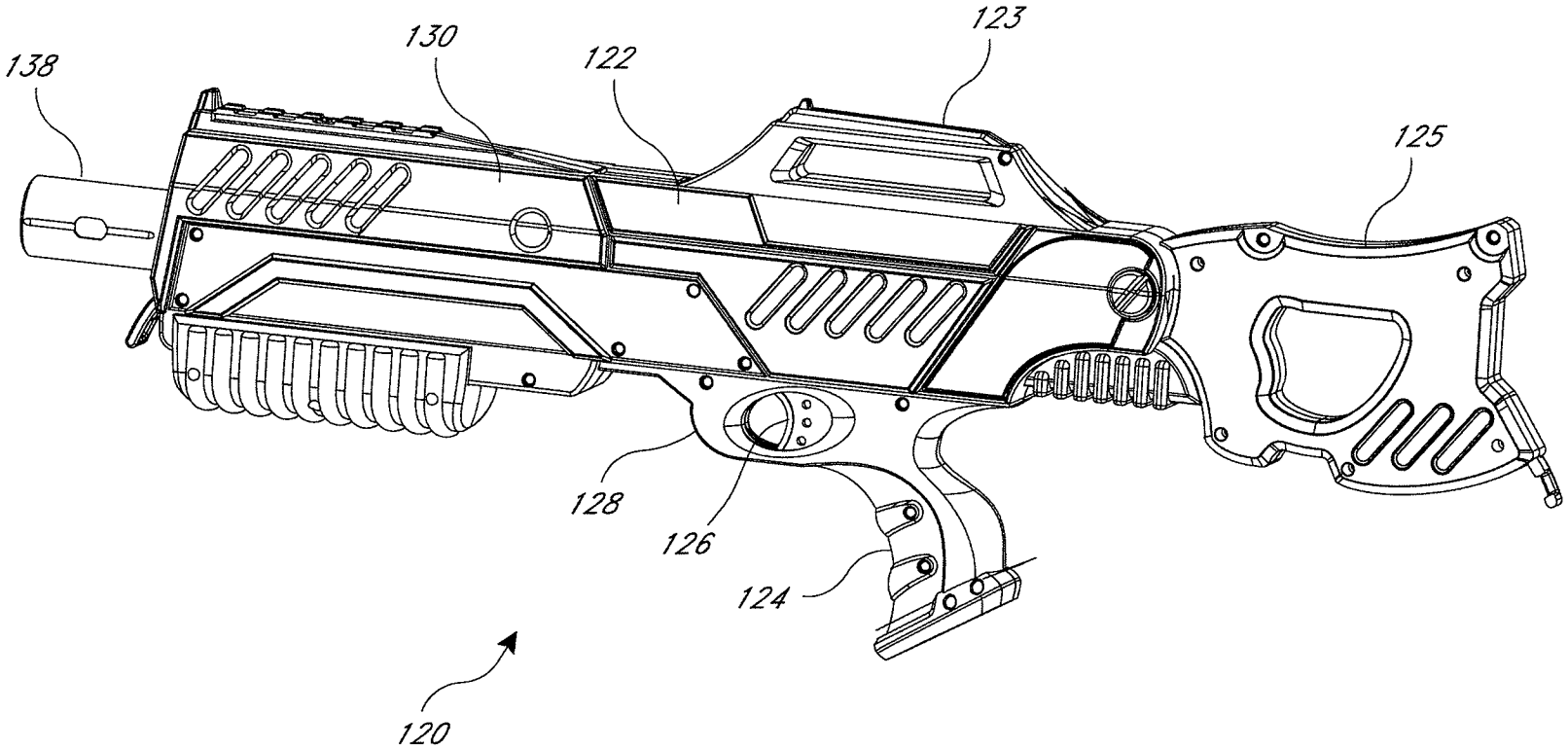
FIG. 7 is a perspective view of another embodiment of a projectile launcher.
Figure 8:
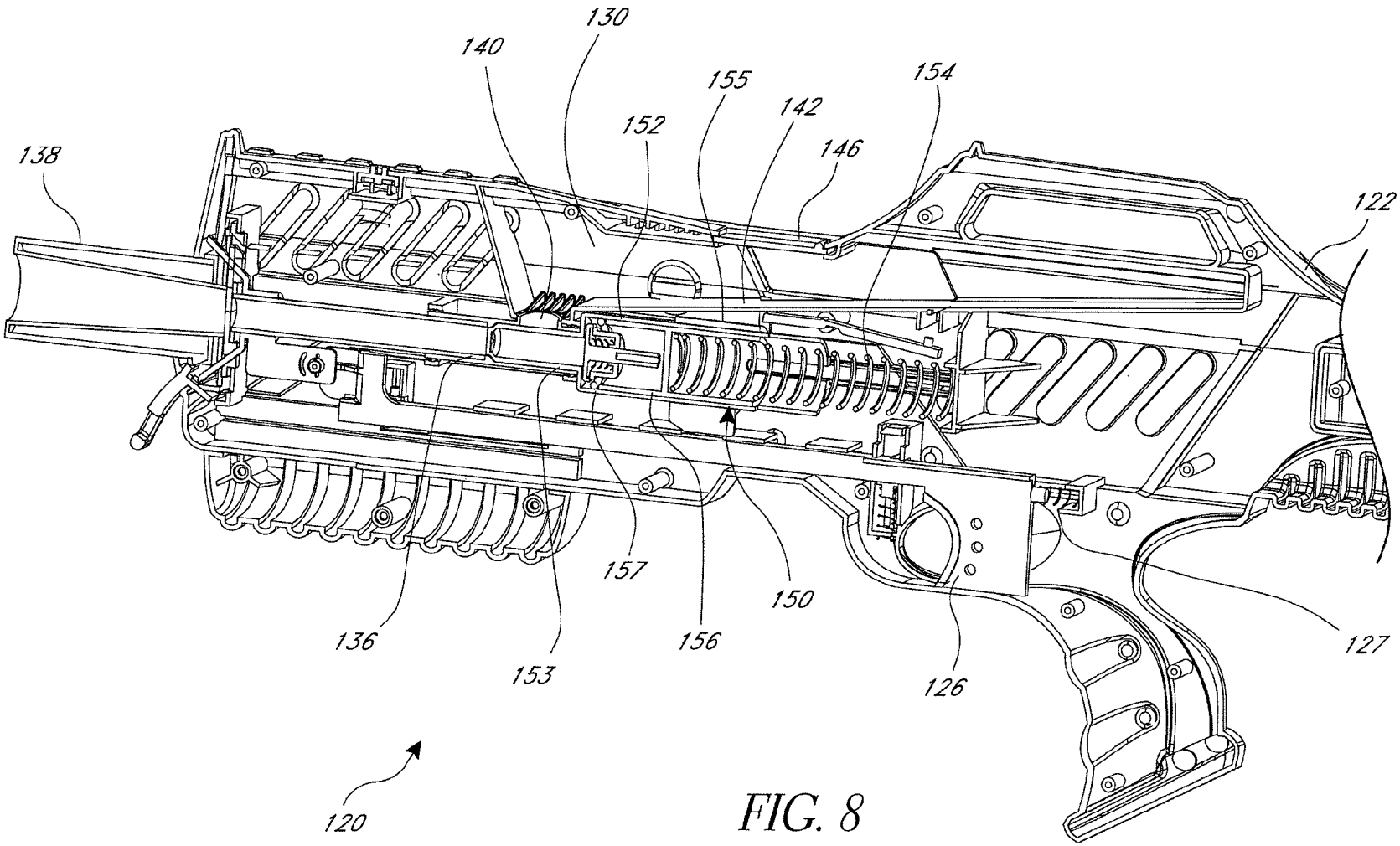
FIG. 8 is a perspective view of a cross section of the projectile launcher of FIG. 7.

With additional reference to FIG. 6, the projectile launcher 20 may also include a positioning mechanism 90 supported by a portion of the barrel 36. The position mechanism 90 includes a base 92 that can be coupled to the barrel 36 and a positioning spring 93. The positioning mechanism 90 also includes a positioning member 94 with a blocking portion, which preferably is spherical in shape and is referred to herein as a spherical portion 95. The barrel 36 includes an opening 96 through which the positioning mechanism 90 extends. Preferably, the opening 96 is located on a position of the barrel that is adjacent the entry portion 40 but offset a short distance toward the muzzle 38, as illustrated. The positioning member 94 is configured so that at least the spherical portion 95 protrudes into the barrel 36 and the path of the projectile. The positioning spring 93 biases the positioning member 94 toward this position in which the spherical portion 95 protrudes into the path of the projectile.

Preferably, when a projectile enters the entry portion 40 of the barrel 36, the spherical portion 95 keeps the projectile from rolling or moving down the barrel 36 toward the muzzle 38 without the projectile being pushed by the loading member 53 of the cylinder 52. Preferably, the entry portion 40 of the barrel 36 is sized and shaped so that only one projectile can enter the barrel 36 at a time. Thus, the positioning member 94 and spherical portion 95 can prevent the projectile from unintentionally rolling toward the muzzle end of the barrel 36 and prevent multiple projectiles from entering the barrel 36. With the projectile in the loaded position within the barrel 36 adjacent the entry portion 40, the loading member 53 moves forward in the barrel and pushes the projectile past the positioning member 94. As the projectile is pushed by the loading member 53, the projectile and loading member 53 may displace the positioning member 94 out of the projectile path as force is transferred from the projectile to the spherical portion 95 and the position spring 93 is compressed. Thus, the positioning member 94 can retract out of the barrel 36 when engaged or pushed by the projectile and loading member 53.

Figure 5A:
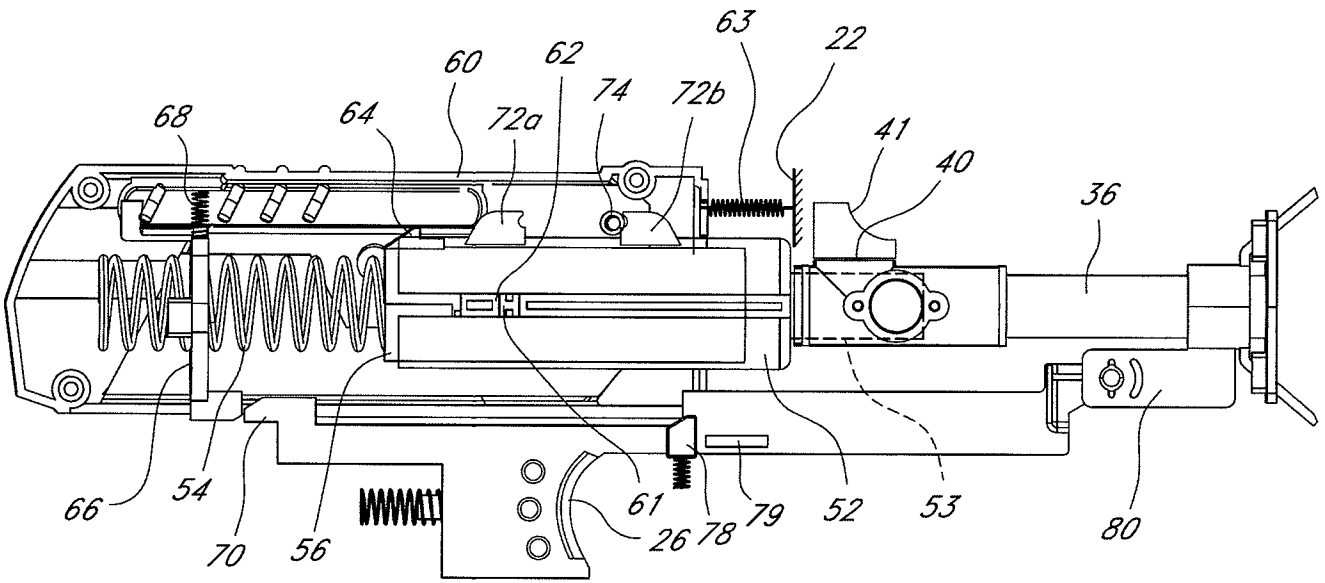
FIGS. 5A-D illustrate the interaction between different parts of the projectile launcher of FIG. 1, during cocking and launching of the launcher.

FIGS. 5A-D illustrate the interaction between the different members of the launching mechanism 50 and the launcher 20. FIGS. 5A-D show the parts of the launching mechanism 50 and other parts of the launcher 20 in several relative positions labeled A-D. In FIG. 5A, the launching mechanism 50 is in the uncocked positioning with the sliding portion 60 and protruding portion 61 in a forward position proximate the barrel 53. The outer cylinder 52 is also forward with the loading member 53 within the entry portion 40 of the barrel 36. The piston 56 is also in an uncocked forward position within the cylinder 52 and proximate the barrel 36. The shaft 74 is adjacent to and/or engaging the front tab 72*b* on the outer cylinder 52. The trigger 26 is in a forward position so that the release portion 70 is not engaging the holding member 66 and the barrel closing mechanism 80 is closed to prevent objects from entering or exiting the barrel 36. In the forward position, the sliding portion 60 engages the stop member 78 so that the stop member 78 is in the aligned position with the pin portion 79. A biasing member or spring 63 is supported by the outer housing 22 and is operatively coupled to the slide portion 60. Preferably, the biasing member 63 biases the slide portion 60 toward the forward position illustrated in FIG. 5A. Preferably, the launching mechanism 50 and its parts resume this forward position after a projectile is launched.

Figure 11A:
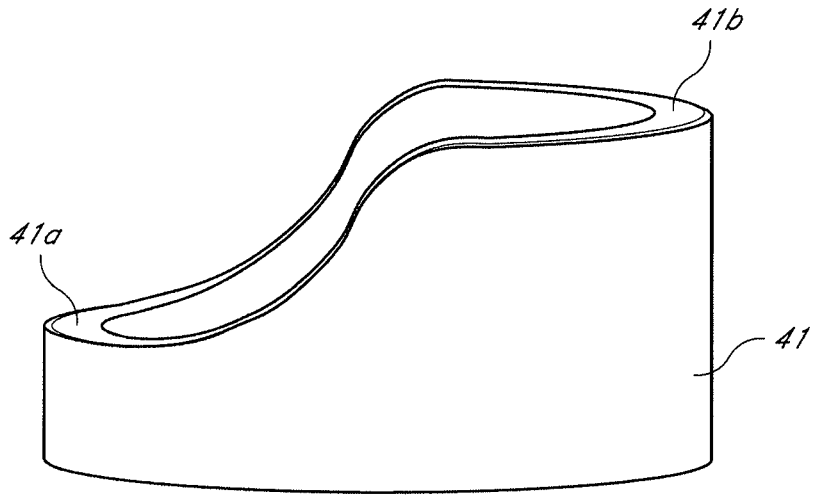
FIGS. 11A and 11B illustrate an embodiment of a projectile receiver.
Figure 11B:
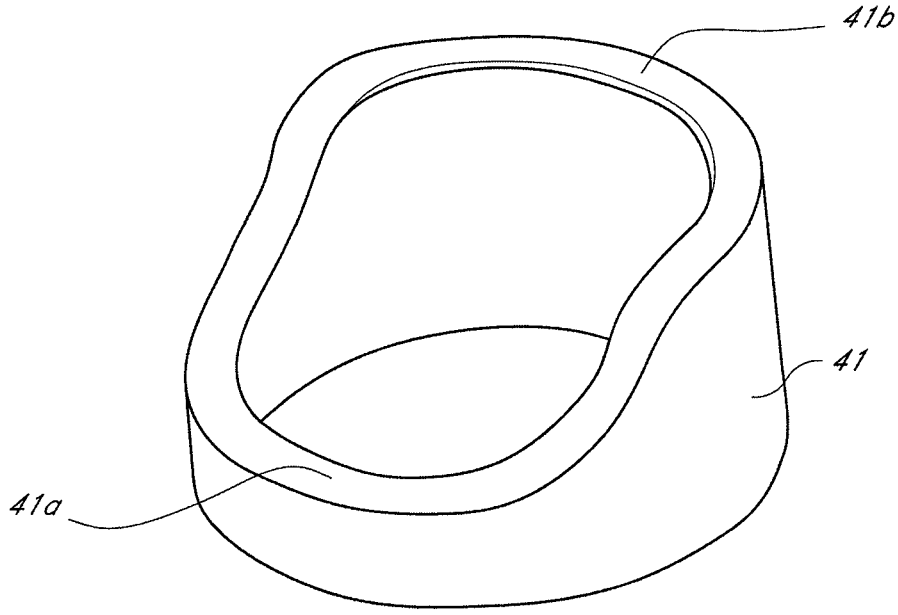

Preferably, the entry portion 40 includes a regulating member, guide member or receiver 41 sized and/or shaped to assist in inhibiting multiple projectiles from entering the barrel 36 during the loading of a projectile into the barrel 36. The receiver 41 is arranged between the reservoir and the entry portion 40 of the barrel 36 and preferably surrounds all or a portion of the opening defining the entry portion 40. The illustrated receiver 41 extends upwardly from the entry portion 40 into the reservoir 30. A preferred embodiment of the receiver is illustrated in FIGS. 11A and 11B and is generally annular in shape, but somewhat elongated. In the illustrated embodiment, the receiver 41 includes an extending or blocking portion 41*b* along a portion of its perimeter and a receiving portion 41 a along another portion of its perimeter. The blocking portion 41*b* defines a first height and the receiving portion 41*a* defines a second height that is less than the first height. When in position at the base of the reservoir 30, the blocking portion 41*b* inhibits entry of projectiles into the receiver 41, and the receiving portion 41*a* allows projectiles to enter the receiver 41 and entry portion 40, one at a time.

Figure 5B:
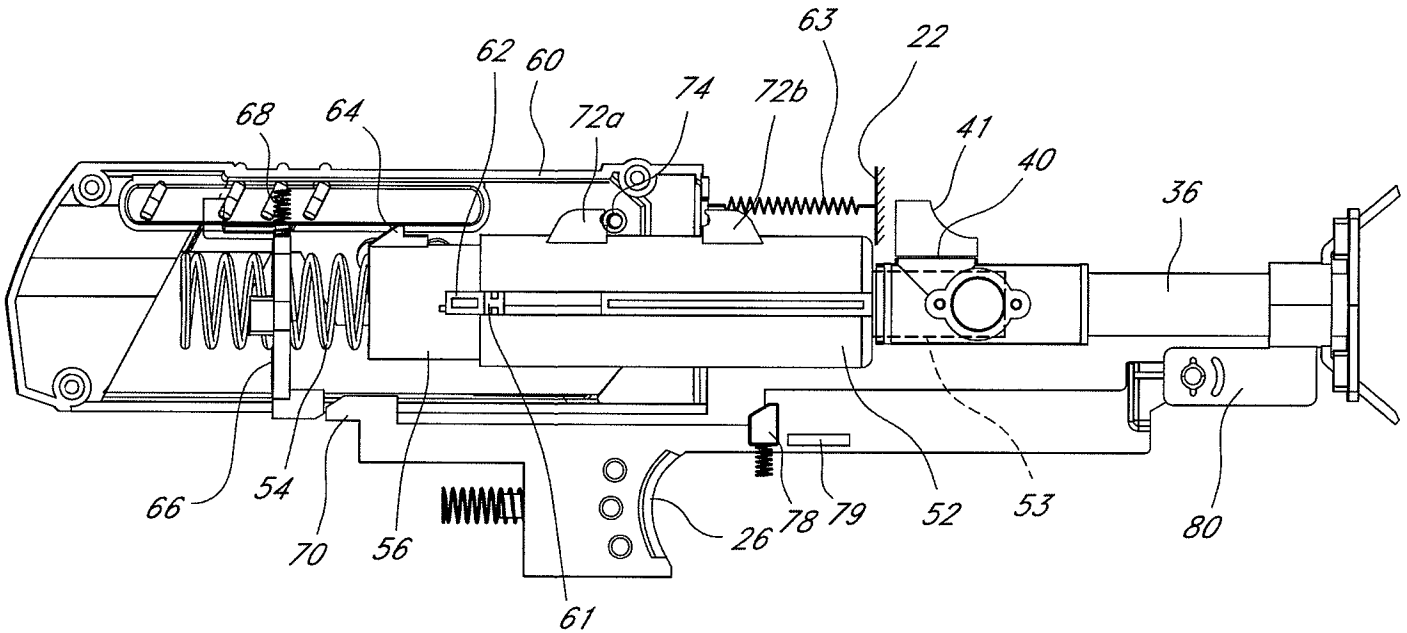

In order to cock the launching mechanism 50 and load a projectile into the barrel 36, a user moves the sliding portion 60 backward away from the barrel 36. As shown in FIG. 5B, the sliding portion 60 and protruding portion 61 slide backward and the protruding portion 61 pulls the tab 62 and the piston 56 backward toward the holding member 66. In the illustrated arrangement, the piston 56 moves at least partially out of the outer cylinder 52. The shaft 74 moves backward away from the front tab 72*b* and engages the rear tab 72*a*. Preferably, any backward movement of the sliding portion 60 moves the piston 56 backward, while backward movement of the sliding portion 60 does not cause the outer cylinder 52 to move until the shaft 74 moves a distance and engages the rear tab 72*a*. As the piston 56 moves backward, the launching spring 54 is compressed. As the sliding portion 60 moves backward away from the barrel 36, it disengages the stop member 78 and the stop member 78 moves upward to the stopping position.

Figure 5C:
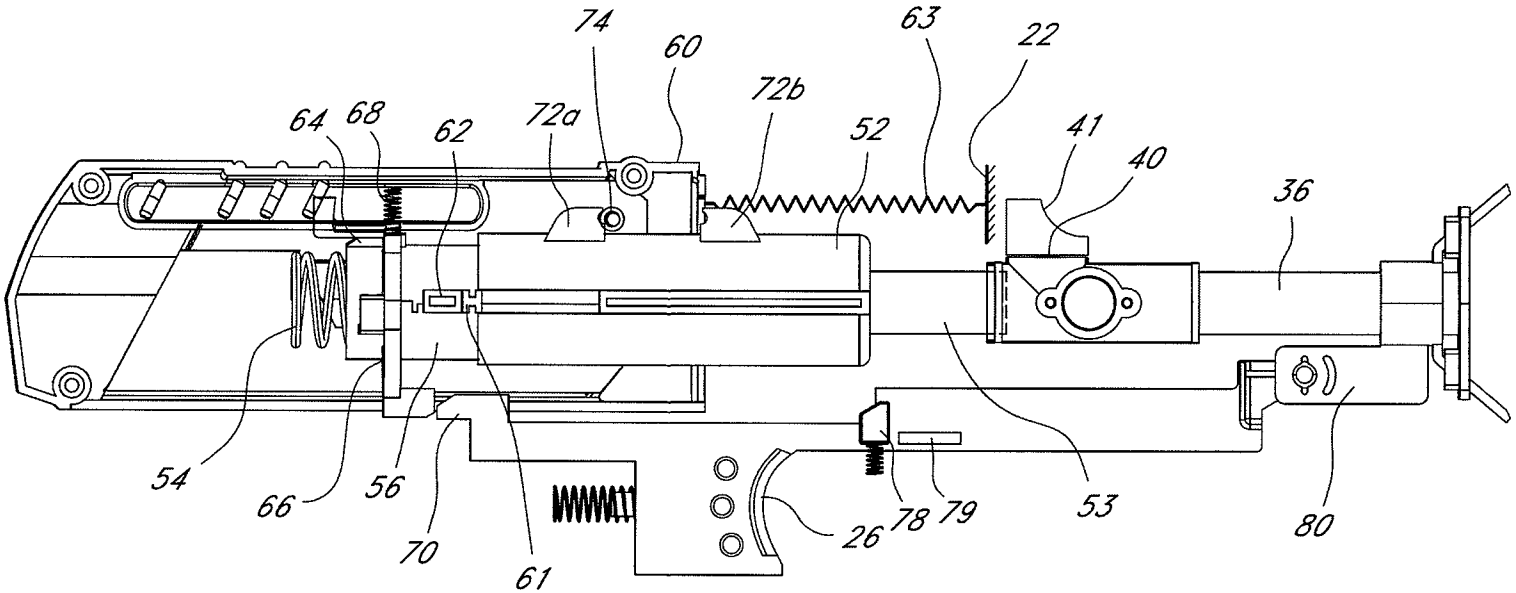

As the user continues to pull the sliding portion 60 backward, the protruding portion 61 moves the piston 56 further rearward toward the holding member 66. The shaft 74 engages the rear tab 72*a* and moves the outer cylinder 52 rearward in the same direction as the piston 56. The protruding portion 61 and shaft 74 move the piston 56 and outer cylinder 52 in a rearward direction until the latch portion 64 moves past and is engaged by the holding member 66 and the loading member 53 is removed from the entry portion 40 of the barrel 36. As illustrated in FIG. 5C, when the sliding portion 60 is moved backward to the cocking position, the latch portion 64 of the piston 56 is engaged and held by the holding member 66. Preferably, the latch portion 64 and the holding member 66 are configured so that, as the piston 56 moves backward, the latch portion engages and displaces the holding member 66 upward. After the latch portion 64 has moved backward past the holding member 66, the holding member 66 moves downward, in response to the biasing force of the biasing mechanism or holding spring 68, and secures the latch portion 64 and piston in a cocked position.

When the sliding portion 60 is in the cocking position, the shaft 74 has moved the outer cylinder 52 rearward so that the loading member 53 is removed from the entry portion 40 of the barrel 36. With the loading member 53 removed from the entry portion 40 of the barrel 36, a projectile can enter the entry portion 40 from the reservoir 30. As described previously, preferably, the positioning mechanism 90 allows only a single projectile to be loaded into the barrel 36 per launching sequence.

Figure 5D:
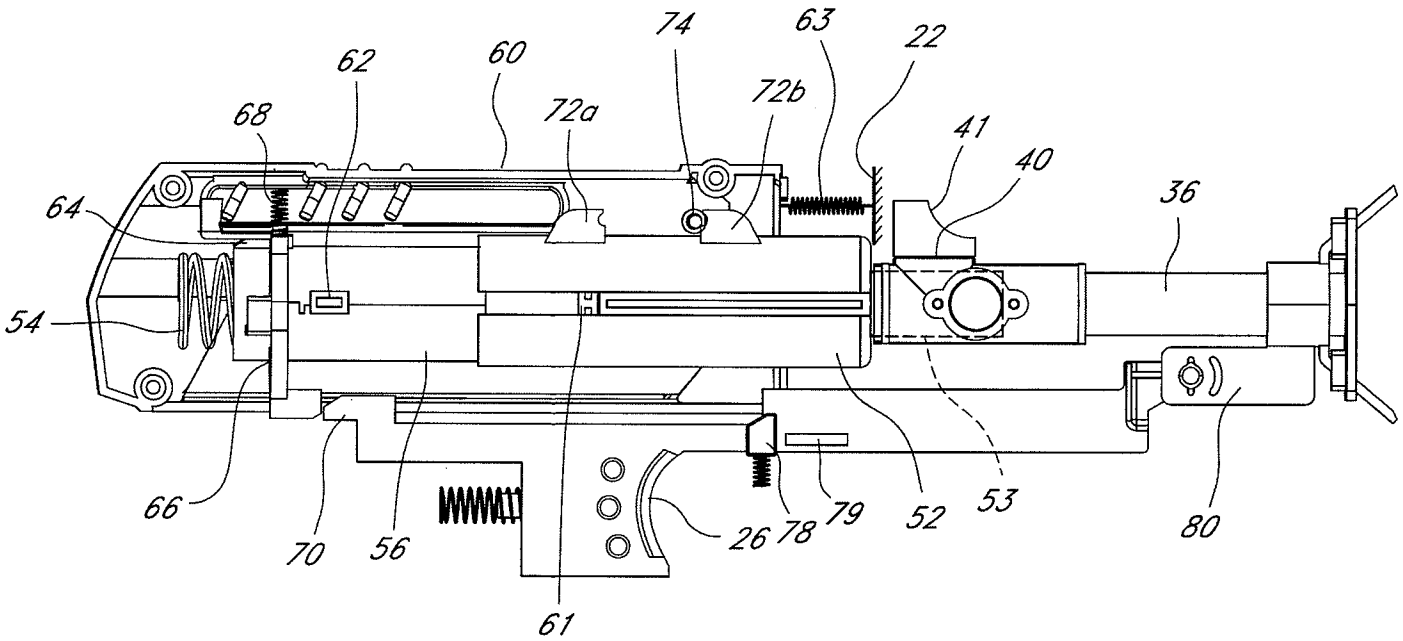

In some embodiments, the user moves the sliding portion 60 forward after cocking the launcher. In other, embodiments, the sliding portion 60 is biased away from the cocking position by the biasing member 63 which moves the sliding portion 60 forward toward the barrel 36 when the sliding portion 60 is released by the user. As the sliding portion 60 moves forward toward the barrel 36, the piston 56 remains in the cocked position, held by the holding member 66. As the sliding portion 60 and protruding portion 61 move forward, the shaft 74 engages the front tab 72*b* and moves the outer cylinder 52 forward. The outer cylinder 52 and loading member 53 move forward and the loading member 53 re-enters the entry portion 40 and pushes the projectile forward within the barrel 36. The shaft 74 and sliding portion 60 move the outer cylinder 52 and loading member 53 forward until the outer cylinder 52 returns to its launching position adjacent the barrel 36 and the loading member 53 has pushed the projectile to its launching position within the barrel 36, as illustrated in FIG. 5D. In the forward launching position, the sliding portion 60 engages the stop member 78 and displaces the stop member 78 downward to a position aligned with the pin portion 79. In this position, the trigger can be pulled by the user and the launching mechanism 50 is ready to launch the projectile. The piston 56 is held back in the launching position and the cylinder 52 is forward with a projectile loaded within the barrel 36.

When a user pulls the trigger 26 backward, the release portion 70 engages the holding member 66 and causes the holding member 66 to move upward. As the holding member 66 moves upward, it releases the latch portion 64 of the piston 56 and the piston 56 is released from the launching position. When released, the piston 56 moves forward due to the force exerted, by the launching spring 54 and generates a burst of air or air pressure within the outer cylinder 52. The piston 56 moves toward the position shown in FIG. 5A and the burst of air or air pressure transfers through the outer cylinder 52 and out of the loading portion 53. The burst of air pushes the projectile through the barrel 36 and launches the projectile out of the muzzle 38. Also, when the user pulls the trigger, the safety mechanism 80 opens and unblocks the end of the barrel 36 so that the projectile can exit the barrel. After launching, the piston 56 and outer cylinder 52 remain in the forward resting position and the loading member 53 prevents a projectile from entering the entry portion 40, until a user again pulls the sliding portion 66 in the backward direction.

As illustrated in FIG. 4, the trigger 26 is biased toward a forward and non-launching position by a trigger spring 27. As described above, the trigger 26 is operatively coupled to the barrel closing mechanism 80 which is preferably supported by the outer housing 22 and/or barrel 36. Pulling the trigger 26 backward to the launching position thus causes the shutter members 86 to open and unblock the end of the barrel 36, allowing a projectile to be launched out of the unblocked barrel 36.

After launching a projectile, the user releases the trigger 26 which moves forward to its resting position. This causes the cylindrical portion 82 of the barrel closing mechanism 80 to move forward toward the muzzle 38. The angled arms 84 move forward toward the muzzle 38 causing the shutter members 86 to move toward the longitudinal axis of the barrel 36 and cover the end of the barrel 36. With the trigger 26 forward and not engaged by the user, the shutter members 86 are in the closed position covering the end of the barrel 36 so that objects cannot enter the barrel 36 through the muzzle 38. This function of covering the end of the barrel 36 can inhibit harm to the launcher 20 or undesirable use of the launcher by keeping undesired objects from entering the barrel 36.

FIGS. 7-10 illustrate another embodiment of a projectile launcher 120, which is similar to launcher 20, but in the form of a rifle. Launcher 120 includes an outer housing 122, a pistol grip portion 124 and a muzzle 138. The launcher 120 also preferably includes a trigger 126 biased in the forward direction by a trigger spring 127, and a trigger guard 128. As illustrated, a projectile reservoir 130 is preferably configured above a barrel 136. In a preferred embodiment, the launcher 120 includes a handle 123 and a shoulder support, or stock, 125. A projectile reservoir 130 preferably includes an opening 144 and a cap or lid 146. The reservoir 130 includes sloped portions 142 configured to direct projectiles toward an entry portion 140 of the barrel 136. The entry portion 140 may include a receiver similar to the receiver 41 of launcher 20, as illustrated in FIGS. 11A and 11B.

The launcher 120 includes a launching mechanism 150 configured to create a burst of air or air pressure to launch the projectile. The launching mechanism 150 includes an outer cylinder 152 with a loading member 153. The launching mechanism 150 also includes a piston 156 that is biased toward the barrel 136 by a launch spring 154. The piston 156 is configured to move within the outer cylinder 152 to create air pressure and force air out of the cylinder 152. Preferably, a sleeve 155 is supported by the outer cylinder 152 and is configured to move along the outer surface of the outer cylinder 152. Preferably, the piston 156 includes a ring or gasket 157 to form a seal with the inner surface of outer cylinder 152.

Figure 9:
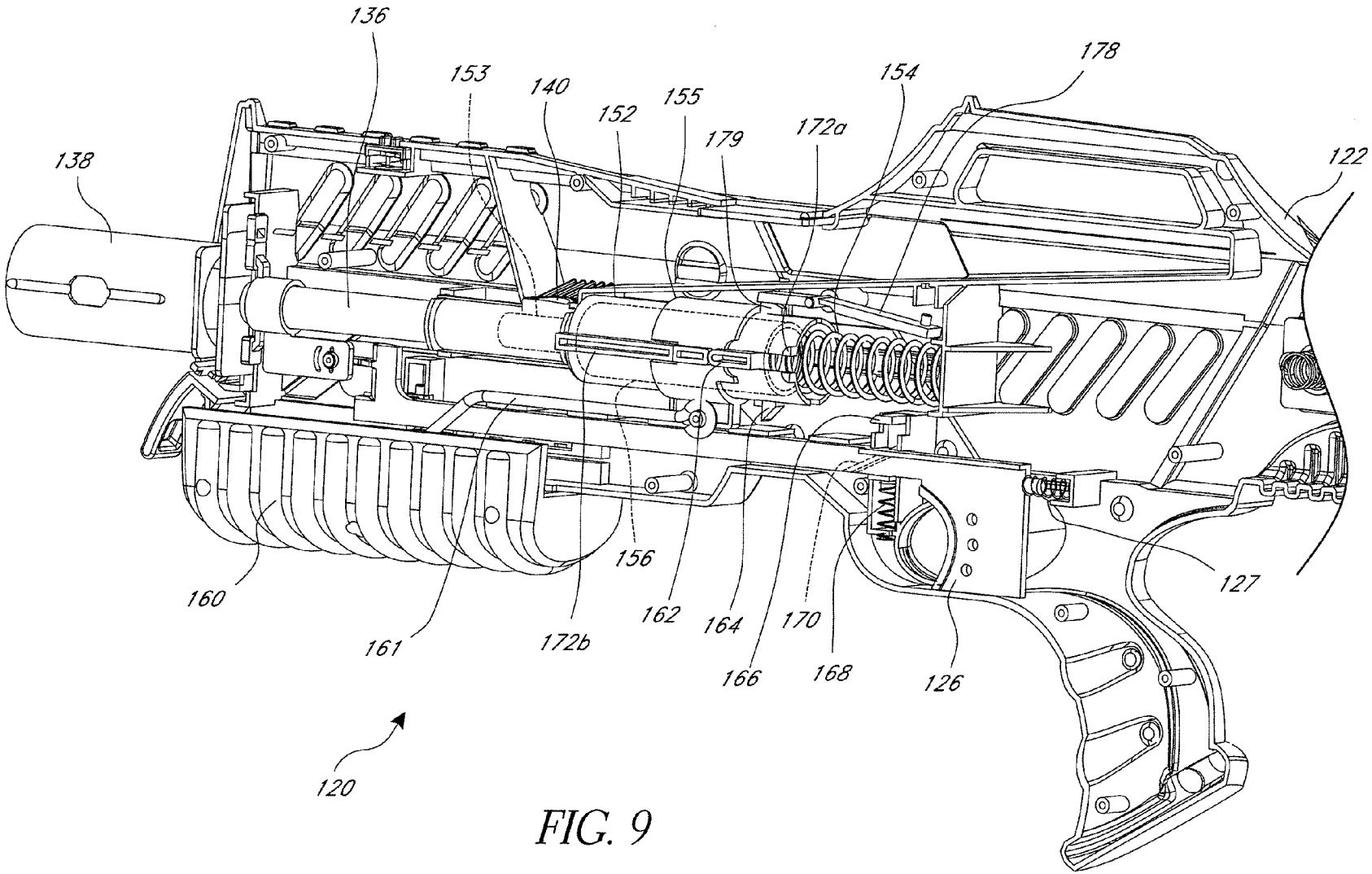
FIG. 9 is a perspective view of the projectile launcher of FIG. 7 with portions of the launcher removed.

As illustrated in FIG. 9, the launcher 120 includes a sliding member 160 configured to slide with respect to the outer housing 122. The sliding member 160 is operatively coupled to the sleeve 155 by an arm 161 so that moving the sliding member 160 in the rearward direction toward the trigger 126 results in movement of the sleeve 155 in the rearward direction. The piston 156 includes a tab 162 that protrudes radially from the piston 156 and beyond the outer cylinder 152. The tab 162 is configured to be engaged by the sleeve 155 as the sleeve moves backward away from the barrel 136. The piston 156 also includes a latch portion 164 configured to engage and be held by a holding member 166. The holding member 166 is supported by the outer housing 122 and preferably can only move vertically in directions perpendicular to the longitudinal axis of the piston 156. The holding member 166 functions in the substantially the same manner as the previous embodiment and is biased toward a holding position by a holding spring 168. The trigger 126 includes a release portion 170 configured to release the piston 156 from the holding member 166 when the trigger 126 is pulled, similar to the previous embodiment. In the illustrated arrangement, the release portion 170 is an angled cam surface that engages an angled portion 171 of the holding member 166 and causes downward movement of the holding member 166 in response to rearward movement of the trigger 126 (and, thus, rearward movement of the angled cam surface).

Preferably, the outer cylinder 152 includes a rear protrusion 172*a* and a front protrusion 172*b*. The rear protrusion 172*a* is located at the rear end of the outer cylinder 152 and is configured to be engaged by the sleeve 155 when the sliding member 160 and outer cylinder 152 move backward. The front protrusion 172*b* is located closer to the barrel 136 than the rear protrusion 172*a* and is engaged by the sleeve 155 when the sleeve 155 and sliding member 160 move forward after moving the piston 156 to the cocked position. Therefore, the outer cylinder 152 moves forward and backward with the sleeve 155 and the sliding member 160. After moving the piston 156 to the cocked position, the sliding member 160 can be moved forward by the user, or the sliding member 160 can include a biasing member arranged to bias the sliding member 160 toward the forward position, similar to the biasing member 63 described in the previous embodiment. The rear protrusion 172*a* and front protrusion 172*b* are spaced from one another to create a lost-motion mechanism, which results in the piston 156 starting to move before the outer cylinder 152 begins to move during the cocking sequence.

In a preferred embodiment, the launching mechanism 150 includes a stop mechanism, which in the illustrated arrangement includes an arm 178 pivotally supported by the housing above the outer cylinder 152 and sleeve 155. When the piston 156 is moved to the cocked position, a top protrusion 179 on the piston 156 engages the stop mechanism 178 and tends to rotate it such that the rearward portion moves up and the forward portion moves down. When the piston 156 is in the cocked position and the sliding member 160 returns to the forward or uncocked position, the forward end of the arm 178 engages a rearward end of the sleeve 155 to prevent the sliding member 160 and sleeve 155 from moving in the rearward direction. This prevents the user from trying to cock and load the launcher 120 when it is already cocked, loaded, and ready to launch.

The launching mechanism 150 functions in a similar manner as the launching mechanism 50 described previously. However, in this embodiment, the sleeve 155 is provided to engage and move the piston 156 to the cocked position. The sleeve 155 also engages and moves the outer cylinder 152 forward and backward in order to load a projectile and push it to a launching position within the barrel 136.

Figure 10:
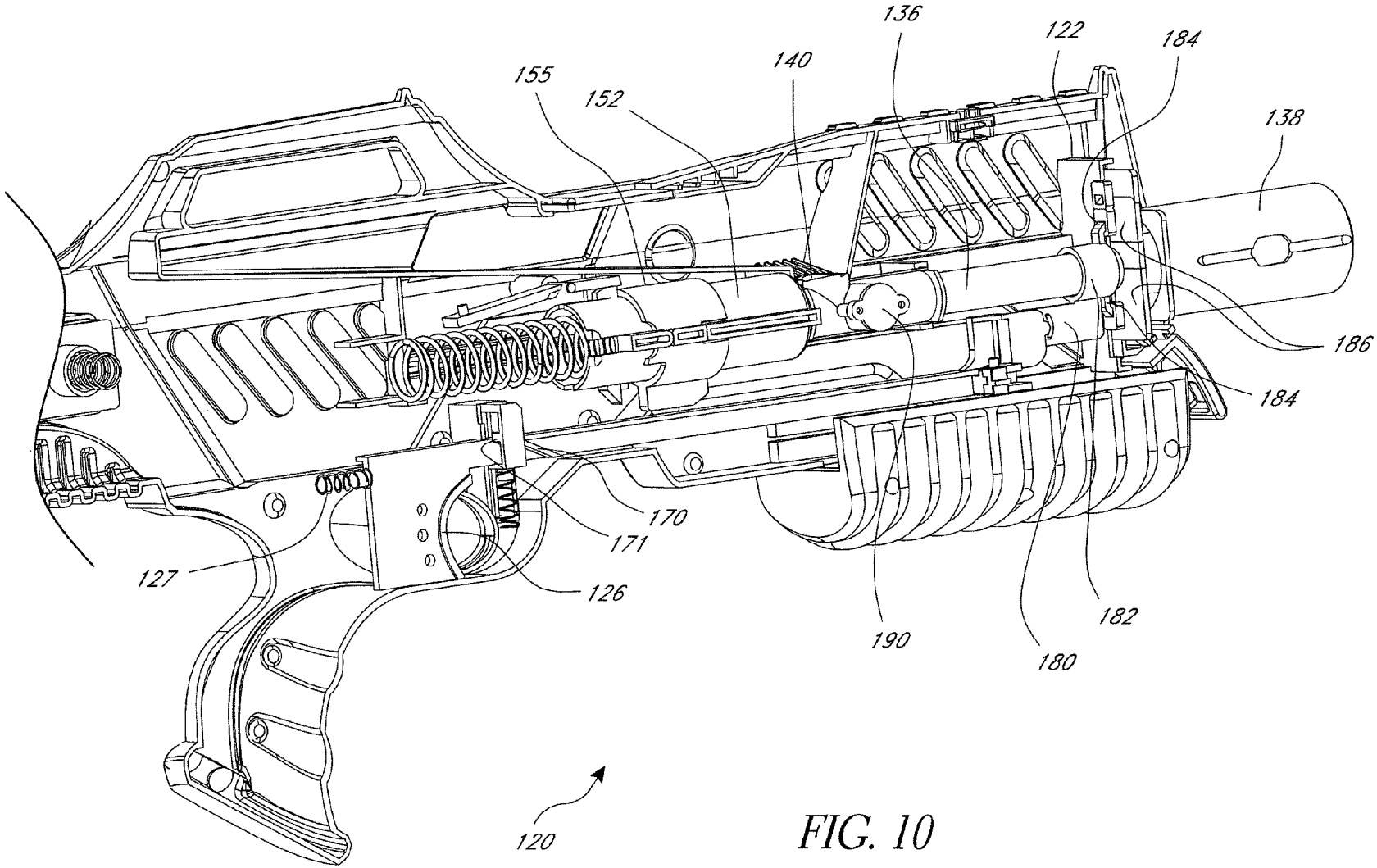
FIG. 10 is a perspective view of the projectile launcher of FIG. 7 with portions of the launcher removed.

As illustrated in FIG. 10, the launcher 120 also includes a barrel closure mechanism 180 similar to the barrel closure mechanism 80 of the launcher 20 described previously. The barrel closure mechanism 180 includes a cylindrical portion 182 and angled arms 184 proximate the end of the barrel 136. The barrel closure mechanism 180 also includes shutter members 186 supported by outer housing 122 and movable toward and away from one another in the vertical direction perpendicular to the longitudinal axis of the barrel 136. In a closed position the shutter members 186 at least partially block or cover the end of the barrel 136. The trigger 126 is operatively connected to the barrel closure mechanism 180 so that when the trigger 126 is pulled backward by a user, the cylindrical portion 182 moves in the backward direction and the angled arms 184 cause the shutter members 186 to open by moving radially outward from the longitudinal axis of the barrel 136. The trigger 126 is biased to a forward resting position by a trigger spring 127 and the barrel closure mechanism 180 is biased toward a position in which the shutter members are closed over the end of the barrel 136. Thus, as described in the previous embodiment, pulling the trigger 126 causes the shutter members 186 to open and releasing the trigger 126 allows the trigger 126 to return to its resting position, and the shutter members 186 close to block the end of the barrel 136.

The projectile launcher 120 also preferably includes a positioning mechanism 190 similar to the positioning mechanism 90 of the previous embodiment. The positioning mechanism 190 protrudes into the barrel 136 to prevent the projectile from moving through the barrel 136 without being pushed by the loading member 153. The loading member 153 is configured to push the projectile from the entry portion 140 past the positioning mechanism 190 to a launching position. As described in the previous embodiment, the positioning mechanism 190 is biased toward protruding into the barrel 136 and path of the projectile, but the projectile and loading member 153 can displace the positioning mechanism 190 in order to move past it.

Figure 12A:
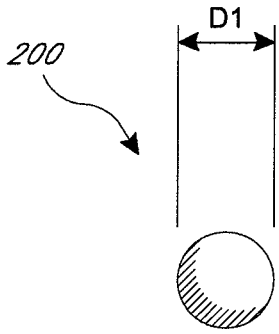
FIGS. 12A and 12B illustrate an embodiment of a projectile before and after being loaded with a liquid.
Figure 12B:
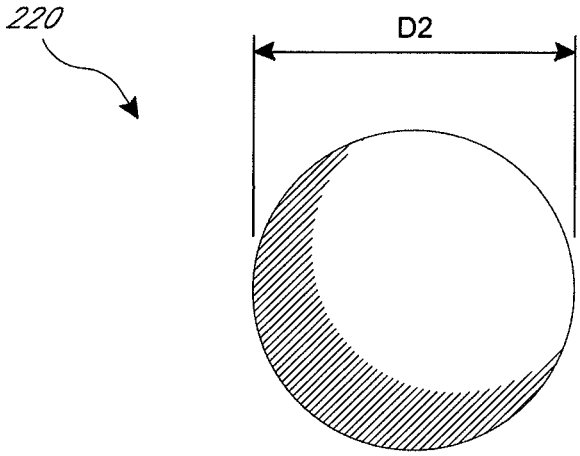

FIG. 12A illustrates an embodiment of a pellet or projectile 200 before it is loaded with a liquid. Preferably, the liquid used to load the projectiles is water, but other liquids can be used. FIG. 12B illustrates an embodiment of a projectile 220 that has been loaded with liquid and is configured to be launched by the launcher 20. Preferably, the projectiles 220 launched by the launcher 20 are made from an acrylic polymer that can absorb large amounts of liquid per unit volume. Such materials are also known as superabsorbent polymers (SAP). In alternative embodiments, only a portion of the projectile is made of a SAP material.

Preferably, the process for manufacturing the projectiles 220 includes producing unloaded projectiles or pellets 200 which include an acrylic polymer or superabsorbent polymer. Preferably, the pellets 200 consist entirely or mostly of superabsorbent polymer, but in some embodiments the pellets 200 can include other materials.

Subsequently, the pellets 200 are soaked in or loaded with a liquid, such as water. This causes the pellets 200 to increase in size and become projectiles 220 that can be launched from the launcher 20. Preferably, the pellets 200 are loaded during the manufacturing process. However, in other arrangements, the pellets 200 can be loaded after the manufacturing process by an intermediate or end user. The soaking time may be selected to result in a desirable amount of water to be absorbed by the pellet 200. For example, if a greater percentage of water is desired, a longer soaking time can be used. Alternatively, the soaking time can be selected such that the pellets 200 absorb an amount of water approaching or equal to the maximum amount possible as determined by the material properties. The loaded projectiles 220 preferably consist of equal to or greater than about 50% liquid or water. In some embodiments, the loaded projectiles 220 consist of equal to or greater than about 75% liquid or water. Preferably, the loaded/soaked projectiles consist of equal to or greater than about 95% water. As a result, the projectile 220 provides a soft impact and leaves little residue behind. The loaded projectiles 220 may then be placed in protective packaging as further described below.

In some embodiments, the projectiles 220 are spherical in shape and sized to fit within the barrel 36 of the launcher 20. The projectiles 220 may be slightly larger than the internal size of the barrel 36 to inhibit undesired movement within the barrel 36 in the absence of a burst of air from the launching mechanism 50 or 150. When loaded with liquid, the pellets may increase greatly in size. In a preferred embodiment, the pellets 200 have an unloaded diameter D1 of about 2 mm. After being loaded or soaked in water, such pellets may increase in size to be projectiles having a diameter D2 of about 12 mm.

Unlike paint balls and other projectiles, the illustrated projectiles 220 are also preferably homogeneous in nature and do not include a hard outer covering. This allows the projectiles 220 to have a softer impact when launched. Similarly, the projectiles 220 may be non-marking. Preferably, the SAP material and the liquid used to load the projectiles are non-marking or leave minimal markings. Unlike projectiles used in many launchers, these projectiles are designed for a one-time use and leave very little residue after being launched.

Figure 13:
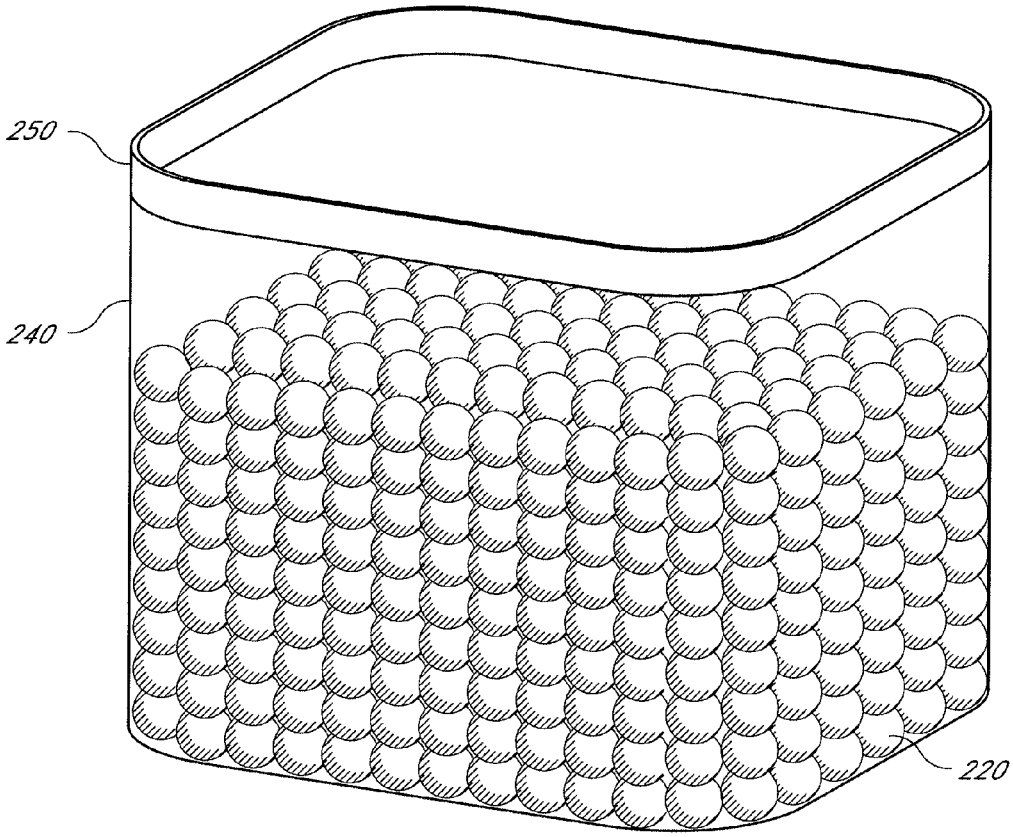
FIG. 13 is a perspective view of an embodiment of packaging for projectiles.

FIG. 13 illustrates an embodiment of the packaging used to store projectiles 220. The packaging includes a container 240 and a lid 250. The lid 250 can be removed to access or pour the projectiles 220. In other embodiments, the packaging may include a container 240 with an integrated lid or hole (not shown) for removing the projectiles 220. The container 240 may be constructed from a rigid material that protects the projectiles from outside forces. Preferably, the container 240 and/or lid are made from a rigid plastic material. The packaging may also be configured so that the container 240 is sealed or airtight so that the projectiles 220 are protected from the outside environment. The packaging or container 240 may also be vacuum-packed or pressurized in order to protect the projectiles 220. In some embodiments, the packaging used to store projectiles 220 is configured to attach to the launcher so that the projectiles enter the reservoir. In such embodiments, a user attaches the packaging, such as a hopper, filled with projectiles to a portion of the launcher and the projectiles move from the packaging into the reservoir of the launcher.

When the projectiles have entered the reservoir, the user can remove the packaging from the launcher.

Figure 14:
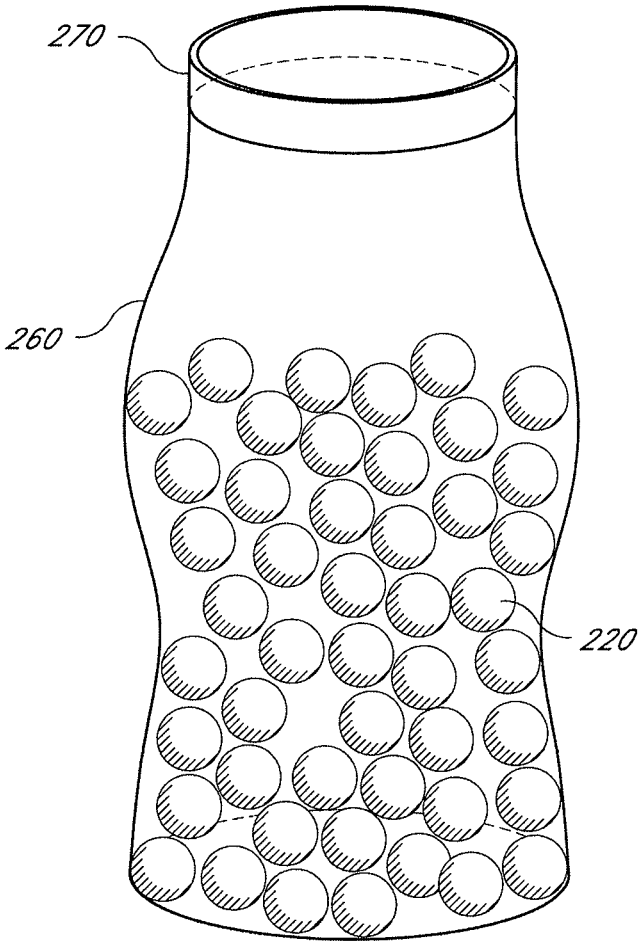
FIG. 14 is a perspective view of another embodiment of packaging for projectiles.

FIG. 14 illustrates a second embodiment of packaging used to store projectiles 220. The packaging includes a cylindrical container 260. Preferably, the container 260 includes a lid 270 or some other type of sealable opening through which the projectiles 220 can be removed. The cylindrical shape makes it easier for the user to pour out the projectiles 220 and load them into the launcher. The cylindrical shape of the container 260 may also provide strength and protection from outside forces. Preferably, the container 260 is made from a rigid material such as plastic. The container 260 may also be pressurized or vacuum-packed to provide added protection for the projectiles.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In particular, while the present systems and methods have been described in the context of particularly preferred embodiments, the skilled artisan will appreciate, in view of the present disclosure, that certain advantages, features and aspects of the systems and methods may be realized in a variety of other applications, many of which have been noted above. Additionally, it is contemplated that various aspects and features of the invention described can be practiced separately, combined together, or substituted for one another, and that a variety of combination and subcombinations of the features and aspects can be made and still fall within the scope of the invention. Thus, it is intended that the scope of the present invention herein disclosed should not be limited by the particular disclosed embodiments described above, but should be determined only by a fair reading of the claims.

What is claimed is:

1. A projectile launcher comprising:

an outer housing comprising a grip portion configured to be grasped by a user;

a barrel having an end and a longitudinal axis;

a projectile configured to move through the barrel, the projectile constructed from a superabsorbent polymer;

a reservoir portion configured to store the projectile, the reservoir portion capable of communicating with the barrel to permit the projectile to move from the reservoir portion to the barrel;

a launching mechanism comprising:

an outer cylinder that is capable of fluid communication with the barrel;

a piston movable within the outer cylinder and configured to generate air pressure within the outer cylinder for launching the projectile from the barrel;

a barrel closure mechanism configured to prevent objects from entering the barrel through a muzzle end of the barrel, the barrel closure mechanism comprising a first shutter member and a second shutter member that selectively block the end of the barrel, the first and second shutter members being configured to move away from one another and away from the longitudinal axis to unblock the end of the barrel.

2. The projectile launcher of claim 1, further comprising a trigger that is operable to release the piston from a cocked position, and wherein actuation of the trigger causes the first and second shutter members to move in directions perpendicular to the longitudinal axis to unblock the end of the barrel.

3. The projectile launcher of claim 1, further comprising a positioning mechanism having a blocking portion that is normally biased to a position in which the blocking portion is located within the barrel to inhibit the projectile from moving past the blocking portion.

4. The projectile launcher of claim 3, wherein a loading member is supported by the outer cylinder and extends in an axial direction from the outer cylinder, the loading member being configured to move into and out of a portion of the barrel in order to permit a projectile to move from the reservoir portion to the barrel, wherein the loading member pushes the projectile past the blocking portion of the positioning mechanism.

5. The projectile launcher of claim 4, wherein the loading member moves out of a portion of the barrel when the piston is moved to a cocked position, allowing the projectile to enter the barrel.

6. The projectile launcher of claim 1, further comprising a slide, a trigger mechanism and a stop mechanism, the slide having a first position and engaging the piston, the slide being movable away from the first position to move the piston to a cocked position relative to the outer cylinder, the slide also being configured to engage the outer cylinder to move the outer cylinder away from the barrel, the trigger mechanism capable of releasing the piston from the cocked position and the stop mechanism configured to inhibit actuation of the trigger mechanism when the slide is not in the first position.

7. The projectile launcher of claim 1, wherein the projectile is spherical in shape.

8. The projectile launcher of claim 1, wherein the projectile is homogeneous.

9. The projectile launcher of claim 1, wherein the barrel closure mechanism includes a sliding portion that at least partially surrounds a portion of the barrel and supports at least one arm portion that engages one of the first and second shutter members.

10. The projectile launcher of claim 2, wherein the housing includes multiple slots in which portions of the first and second shutter members slide.

11. A projectile launcher comprising:

an outer housing comprising a grip portion configured to be grasped by a user;

a slide that moves relative to the outer housing;

a barrel and a projectile configured to move through the barrel, the projectile constructed from a superabsorbent polymer;

a reservoir portion configured to store the projectile, the reservoir portion capable of communicating with the barrel to permit the projectile to move from the reservoir portion to the barrel;

a launching mechanism comprising:

an outer cylinder that is capable of fluid communication with the barrel;

a piston movable within the outer cylinder and configured to generate air pressure within the outer cylinder for launching the projectile from the barrel; and a loading member supported by the outer cylinder and extending from the outer cylinder in an axial direction, a portion of the loading member being configured to move within a portion of the barrel, the loading member being configured to move a projectile to a launching position within the barrel;

wherein the slide has a first position relative to the barrel and the slide engages the outer cylinder, the slide being movable away from the first position in a first direction relative to the barrel to move the outer cylinder and loading member in the first direction relative the barrel.

12. The projectile launcher of claim 11, wherein the barrel includes a longitudinal axis and an end, the projectile launcher further comprising a barrel closure mechanism comprising a first shutter member and a second shutter member that selectively block the end of the barrel, the first and second shutter members being configured to move away from and perpendicular to the longitudinal axis to unblock the end of the barrel.

13. The projectile launcher of claim 11, further comprising a positioning mechanism having a blocking portion that is biased to a position in which the blocking portion is located within the barrel to inhibit the projectile from moving past the blocking portion, wherein the loading member pushes the projectile past the blocking portion of the positioning mechanism.

14. The projectile launcher of claim 11, wherein the slide has a second position and engages the piston, the slide being movable away from the second position to move the piston to a cocked position relative to the outer cylinder.

15. The projectile launcher of claim 14, further comprising a trigger mechanism that releases the piston from the cocked position and a stop mechanism configured to inhibit actuation of the trigger mechanism when the slide is not in the second position.

16. A projectile launcher comprising:

an outer housing comprising a grip portion configured to be grasped by a user;

a barrel and a projectile configured to move through the barrel, the projectile constructed from a superabsorbent polymer;

a slide that moves relative to the outer housing and the barrel;

a positioning mechanism having a blocking portion that is biased toward a position in which the blocking portion is located within the barrel to inhibit the projectile from moving past the blocking portion; and a launching mechanism comprising:

an outer cylinder that is movable relative to the barrel and is capable of fluid communication with the barrel;

a piston that is movable within the outer cylinder and configured to generate air pressure within the outer cylinder for launching the projectile from the barrel; and a loading member configured to move within a portion of the barrel and move a projectile to a launching position within the barrel;

wherein the slide has a launching position relative to the barrel in which the slide engages the piston, the slide being movable from the launching position to move the piston relative the barrel in the same direction as the slide;

wherein the slide has a second position relative to the barrel in which the slide engages the outer cylinder, the slide being movable from the second position to move the outer cylinder relative to the barrel in the same direction as the slide.

17. The projectile launcher of claim 16, further comprising a barrel closure mechanism comprising a first shutter member and a second shutter member that selectively block an end of the barrel, the first and second shutter members being configured to move away from one another to unblock the end of the barrel.

18. The projectile launcher of claim 16, further comprising a positioning mechanism having a blocking portion that is biased by a spring to a position in which the blocking portion is located within the barrel to inhibit the projectile from moving past the blocking portion.

19. The projectile launcher of claim 16, further comprising a trigger mechanism and a stop mechanism, the trigger mechanism capable of releasing the piston from a cocked position and the stop mechanism configured to inhibit actuation of the trigger mechanism when the slide is not in the launching position.

20. The projectile launcher of claim 16, wherein the slide has a third position relative to the barrel in which the slide engages the outer cylinder, the slide being movable from the third position toward the launching position to move the outer cylinder toward the barrel.

* * * * *